US008190058B2

(12) United States Patent
Takeyama et al.

(10) Patent No.: US 8,190,058 B2
(45) Date of Patent: May 29, 2012

(54) DRUM CARTRIDGE INCLUDING DETACHABLE SPACER MEMBER AND ELECTROPHOTOGRAPHIC IMAGE FORMING APPARATUS

(75) Inventors: Yoshifumi Takeyama, Mishima (JP); Yuuki Nakamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 426 days.

(21) Appl. No.: 12/549,557

(22) Filed: Aug. 28, 2009

(65) Prior Publication Data

US 2010/0054797 A1 Mar. 4, 2010

(30) Foreign Application Priority Data

Sep. 1, 2008 (JP) ..... 2008-223401

(51) Int. Cl.
*G03G 21/18* (2006.01)

(52) U.S. Cl. ..... 399/111; 399/114

(58) Field of Classification Search ..... 399/111, 399/114, 227

See application file for complete search history.

(56) References Cited

U.S. PATENT DOCUMENTS 6,937,834 B2 * 8/2005 Kanno et al. ..... 399/114
7,822,357 B2 * 10/2010 Kim ..... 399/114

FOREIGN PATENT DOCUMENTS

JP 11-184351 A 7/1999
JP 3061805 B2 4/2000
JP 2000-172142 A 6/2000
JP 2005-91708 A 4/2005

* cited by examiner

*Primary Examiner* — William J Royer
(74) *Attorney, Agent, or Firm* — Fitzpatrick, Cella, Harper & Scinto

(57) ABSTRACT

A drum cartridge detachably mountable to an electrophotographic image forming apparatus, which apparatus including a main assembly, and a supporting member, swingably mounted to the main assembly, for supporting a plurality of developing devices and for bringing the developing devices sequentially to a developing position by rotation thereof, the apparatus including an electrophotographic photosensitive member drum; and a detachable spacer member for moving the supporting member away from the electrophotographic photosensitive member drum by contacting to the supporting member when the drum cartridge is mounted to the main assembly.

6 Claims, 20 Drawing Sheets

(a)

(b)

DRUM CARTRIDGE INCLUDING DETACHABLE SPACER MEMBER AND ELECTROPHOTOGRAPHIC IMAGE FORMING APPARATUS

FIELD OF THE INVENTION AND RELATED ART

The present invention relates to a drum cartridge and an electrophotographic image forming apparatus.

Here, the electrophotographic image forming apparatus forms an image on a recording material using an electrophotographic image forming process. It includes an electrophotographic copying machine, an electrophotographic printer (LED printer, a laser beam printer and the like), an electrophotographic facsimile device, an electrophotographic word processor and the like.

In addition, the drum cartridge is provided with at least an image bearing member (electrophotographic photosensitive member drum), is unified into a cartridge form, and is detachably mountable to a main assembly of the electrophotographic image forming apparatus.

In the electrophotographic image forming apparatus such as a printer, an image bearing member charged uniformly is selectively exposed correspondingly to image information to form a latent image. This latent image is visualized by a developer, and a developer image is transferred onto the recording material. The transferred developer image is fixed into a fixed image by a fixing device on the recording material. A untransferred developer is removed by a cleaning device from the image bearing member after the transferring of the developer image on the recording material so as to be used repeatedly for image formation In such an electrophotographic image forming apparatus, whenever the developer is used up, it is necessary to supply the developer, but a replenishing operation of this developer may be troublesome, and may be accompanied by contamination. Furthermore, a special service person is required for the maintenance of each member, and it is inconvenient to the user.

In view of this, the image bearing member, and a charging means, a developing means or a cleaning means which are examples of process means are integrated into a process cartridge as a unit. This cartridge is put in practical use, and it is detachable and mountable relative to a main assembly of the electrophotographic image forming apparatus, and the user loads the main assembly with the process cartridge. The supplying of the developer, and the exchange of the image bearing member which has reached the end of lifetime are made easy by the employment of the process cartridge. In the process cartridge, at least one of the charging means, developing means and cleaning means as the process means, and the image bearing member are integrated into the process cartridge as the unit, and the process cartridge is detachably mountable to the main assembly of the image forming apparatus.

In addition, in a type of an electrophotographic color image forming apparatus, a plurality of developing means are held rotatably relative to the image bearing member. For example, in the electrophotographic color image forming apparatus shown in Japanese Patent 3061805, there are provided a plurality of developing cartridges each including a developer carrying member and a developer accommodating portion as the process means, and a drum cartridge including an image bearing member and cleaning means. In addition, the developing cartridges are disposed detachably mountable substantially around a circle on a rotatable supporting member, and a developing zone of each developing cartridge is sequentially brought to a position opposed to the image bearing member by the rotation of the rotatable supporting member. Since the color image can be formed by one small image bearing member, such an image forming apparatus is advantageous from the standpoint of the downsizing of the main assembly. In the small electrophotographic color image forming apparatus described above, a plurality of the developing cartridges each including at least a developer carrying member, and a plurality of drum cartridges which have at least an image bearing member are detachably mountable to the main assembly of the electrophotographic image forming apparatus individually.

Then, the description will be made about a packing type at the time of shipping of the main assembly and the process cartridge for the electrophotographic image forming apparatus of a process cartridge mounting and dismounting type including the developing cartridge and drum cartridge described above. In example 1 of a shipping type, the main assembly, and the process cartridge are packed in individual cases. In example 2, the main assembly and the process cartridge are packed in one large case, and the case is transported. In example 3, it is shipped in the state that the process cartridge is mounted to the inside of the main assembly. With example 3, the number and a size of the packing materials at the time of transportation can be made small, and therefore, the amount of the packing material is reducible.

In this example, during the transportation, by the rubbing in an interface part between the process cartridge and the main assembly, i.e., a contact portion between the image bearing member and a transfer roller, damage and the like may be produced on the surfaces. In order to solve this problem, various methods are proposed in Japanese Laid-open Patent Application Hei 11-184351, and Japanese Laid-open Patent Application 2005-91708, for example.

In Japanese Laid-open Patent Application Hei 11-184351, in shipping the process cartridge in the state that the process cartridge is mounted to the inside of the main assembly, a closed drum shutter functions as a spacer member for spacing the transfer roller and the image bearing member from each other. And, by switching the drum shutter after the unpacking, the drum shutter opens at the time of the remounting, and the transfer roller and the image bearing member contact to each other.

In Japanese Laid-open Patent Application 2005-91708, the process cartridge is shipped in the state that it is fixed by a fixing member in a position partway along a mounting and demounting locus in the main assembly.

SUMMARY OF THE INVENTION

The present invention further develops the conventional structure described above.

It is a principal object of the present invention to provide a drum cartridge, and an electrophotographic image forming apparatus, wherein a drum cartridge is packed and transported in the state that it is mounted to a main assembly. According to the present invention, the spacing and anchoring for transportation can be easily released by the user.

According to an aspect of the present invention, there is provided a drum cartridge detachably mountable to an electrophotographic image forming apparatus, which apparatus including a main assembly, and a supporting member, swingably mounted to the main assembly, for supporting a plurality of developing devices and for bringing the developing devices sequentially to a developing position by rotation thereof, the apparatus including an electrophotographic photosensitive member drum; and a detachable spacer member for moving the supporting member away from the electrophotographic photosensitive member drum by contacting to the supporting member when the drum cartridge is mounted to the main assembly.

According to another aspect of the present invention, there is provided an electrophotographic image forming apparatus forming an image on a recording material, the electrophotographic image forming apparatus including (i) a supporting member, swingably mounted to a main assembly, for supporting a plurality of developing devices and for bringing the developing devices sequentially to a developing position by rotation thereof; (ii) mounting means; (iii) a drum cartridge mounted to the mounting means and including an electrophotographic photosensitive member drum, and a detachable spacer member for moving the supporting member away from the electrophotographic photosensitive member drum by contacting to the supporting member when the drum cartridge is mounted to the main assembly of the apparatus; and (iv) feeding means for feeding the recording material.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

The preferred embodiments of the present invention will be described in conjunction with the accompanying drawings. However, these examples and the embodiment show the typical type of the present invention, and the present invention is not limited to these examples or the embodiments.

Embodiment 1

(General Arrangement of Electrophotographic Image Forming Apparatus)

Figure 1:
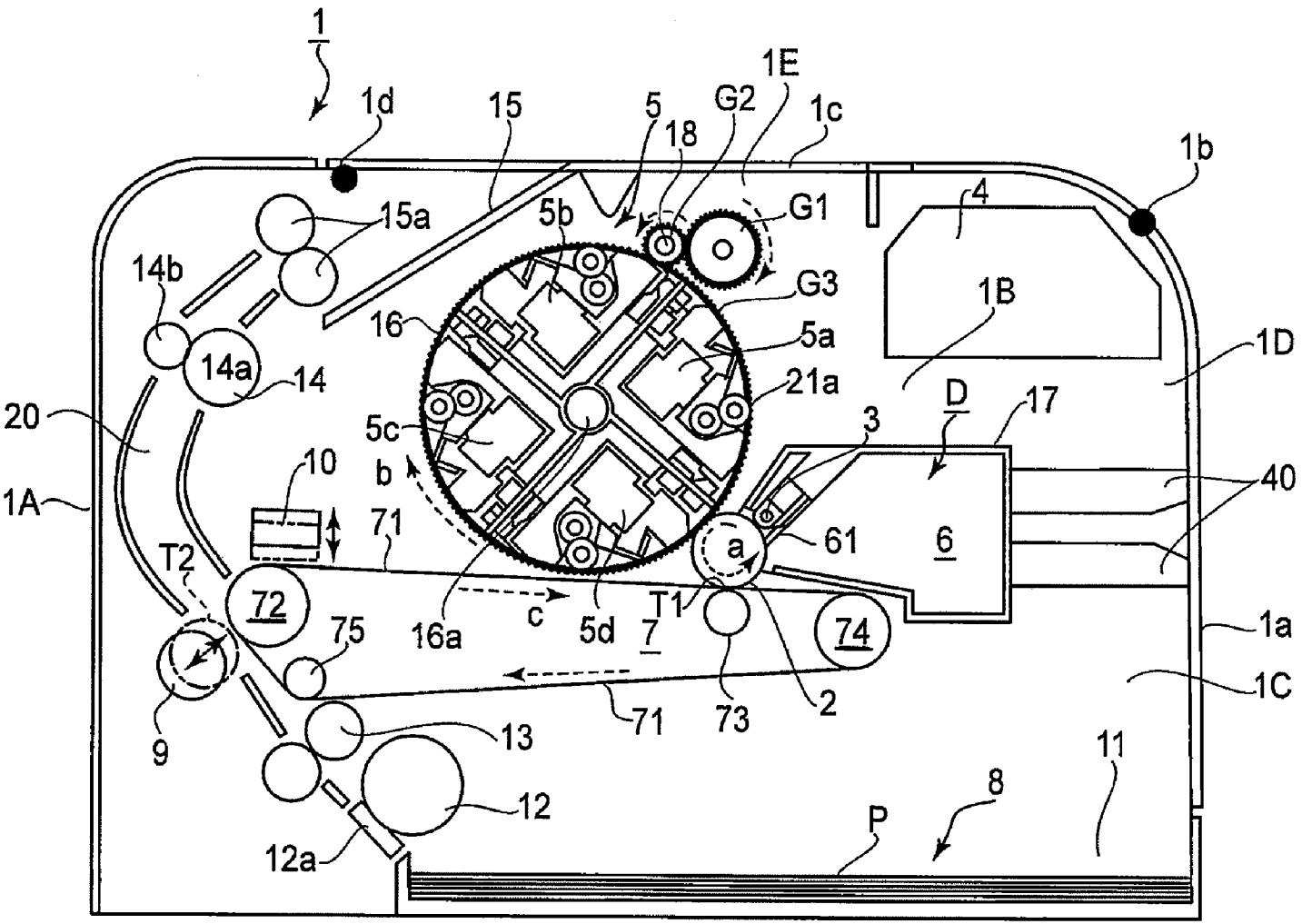
FIG. 1 is a general arrangement of an image forming apparatus according to embodiment 1 of the present invention (at the time of stand-by state).

FIG. 1 is a general arrangement of an electrophotographic image forming apparatus 1 (image forming apparatus) in the present embodiment. This image forming apparatus 1 is a full-color laser beam printer using an electrophotographic process. An image is formed on a sheet-like recording material P (a recording sheet, a OHP sheet, a label, and the like) on the basis of an electric image signal inputted from a host apparatus (unshown) such as a personal computer, an image reader, a receiving part of a facsimile device to a control circuit portion (unshown). The control circuit portion (control means, CPU) sends, and receives various electrical information between the host apparatus between an operating portion (unshown) and itself, and totally controls an image forming operation of the image forming apparatus 1 in accordance with a predetermined controlling program and a predetermined reference table. Therefore, the image forming operation which will be described hereinafter is controlled by the control circuit.

The image forming apparatus 1 is provided with an electrophotographic photosensitive drum (drum) 2 as a rotatable image bearing member therein. The drum 2 is rotated at a predetermined speed (process speed) in a counterclockwise direction indicated by the broken line arrow a by a driving mechanism (unshown). Around the drum 2, process means which act on the drum 2 are provided. In this embodiment, these include charging means 3 for charging the drum 2 uniformly, exposure means 4 for forming a latent image by selectively exposing a charged surface of the drum 2, and developing means 5 for visualizing the latent image by a developer (visualizing powder or toner). In addition, it further includes drum cleaning means 6 for removing the toner remaining after primary image transfer on the drum 2.

In this embodiment, the charging means 3 includes a contact type charging roller. The exposure means 4 is a laser scanner.

The developing means 5 is of a rotary member type comprising a supporting member (a rotatable supporting member or rotary member) 16 which is rotated while supporting a plurality of developing devices, and sequentially brings the developing devices to a developing position. In this embodiment, the developing means 5 has a yellow developing device 5*a*, a magenta developing device 5*b*, a cyan developing device 5*c* and a black developing device 5*d* for visualizing the latent images formed on the drum 2 with the chromatic toner. The yellow developing device 5*a* contains a toner of a yellow (Y) color. The magenta developing device 5*b* contains a toner of a magenta (M) color. The cyan developing device 5*c* contains a toner of a cyan (C) color. The black developing device 5*d* contains a toner of a black (Bk) color. The rotary member 16 is rotatable about the axis of a central shaft 16*a*, and a rotational force of a driving gear G1 driven by an electric rotary member driving mechanism (unshown) is transmitted to a rotary member gear G3 through an idler gear G2. By this, the rotary member 16 is rotated in the clockwise direction indicated by a broken line arrow b about the axis of the central shaft 16*a*. The control circuit portion controls the electric rotary driving mechanism to index the rotary member 16. Each developing device 5*a*, 5*b*, 5*c*, 5*d* may be fixed relative to the rotary member 16, or it may be detachably mountable relative to the rotary member 16 (stationary type) developing cartridge type. In the case of the stationary type, toner replenishing means for supplying the toner into the developing devices 5*a*, 5*b*, 5*c*, and 5*d* is provided. In this embodiment, each developing device 5*a*, 5*b*, 5*c*, 5*d* is of the developing cartridge type.

The drum cleaning means 6 is of a blade type which has a cleaning blade 61 as a cleaning member. The toner removed from the drum surface by the cleaning blade 61 is accommodated in a cleaning container 17.

In this embodiment, the drum 2, the charging means 3, and the drum cleaning means 6 are unified into a drum cartridge D and the drum cartridge D is detachably mountable to a predetermined drum cartridge mounting portion 1B of a main assembly 1A of the image forming apparatus 1. The main assembly 1A is the portion of the image forming apparatus 1 except for the drum cartridge D.

Below the drum cartridge D, and the developing means 5, an intermediary transfer member unit 7 as a transferring means is provided. This unit 7 has a flexible endless belt (belt) 71 made of a dielectric member as an intermediary transfer member. And, the unit 7 has a secondary transferring opposing roller 72, a primary transfer roller 73, a tension roller 74, and a belt driving roller 75 which supports and stretches the belt 71. The primary transfer roller 73 is urged through the belt 71 toward the drum 2. A contact portion between the drum 2 and the belt 71 is a primary transfer nip portion T1. By the tension roller 74 being driven, the belt 71 is circulated at the speed corresponding to the rotational speed of the drum 1 in the clockwise direction indicated by a broken line arrow c.

A belt supporting portion of the secondary transferring opposing roller 72 is provided with a secondary transfer roller 9. This secondary transfer roller 9 is shifted between an operative position indicated by the chain lines two-dot opposed to the secondary transferring opposing roller 72 interposing the belt 71 and a non-operative position indicated by the solid lines spaced from the belt 71, by a moving mechanism (unshown). Normally, it is held in the non-operative position. It is shifted to the operative position at predetermined control timing. In the state that the secondary transfer roller 9 is in the operative position, the contact portion between the secondary transfer roller 9 and the belt 71 is a secondary transfer nip portion T2.

In the belt supporting portion of the secondary transferring opposing roller, 72, a belt cleaner 10 as belt cleaning means is provided, in a downstream side with respect to a belt moving direction, of the secondary transfer roller 9. The belt cleaner 10 removes a secondary untransferred toner from a surface of the belt 71. This belt cleaner 10 is shifted between an operative position in which the cleaning member contacts to the surface of the belt 71 indicated by the chain lines two-dot, and a non-operative position in which the cleaning member spaces from the belt 71 indicated by the solid lines, by the moving mechanism (unshown). Normally, it is held in the non-operative position. It is shifted to the operative position at the predetermined control timing.

A recording material feeding unit 8 is provided below the intermediary transfer member unit 7. This unit 8 comprises a sheet feeding cassette 11 which stacks recording materials P, a sheet feeding roller 12, and a separation pad 12*a*.

A recording material feeding path (feeding means for feeding the recording material) 20 upwardly extended from the sheet feeding roller 12 is provided. A registration roller couple 13, the secondary transfer roller 9, a fixing device 14, and a sheet discharging roller pair 15*a* are provided in the direction from the lower portion to the upper portion of the recording material feeding path 20. The fixing device 14 has a fixing roller 14*a*, and a pressing roller 14*b*. The upper surface of the main assembly 1A is provided with a sheet discharge tray 15.

The operation for forming a full-color image will be described. FIG. 1 shows a standby state of the image forming apparatus 1. The rotary member 16 has a rotation angle position in which the yellow developing device 5*a* faces a front side (in FIG. 1, rightward), as a home position, and it is held in a non-rotating state in this position. In this state, the control circuit portion waits for an image formation starting signal.

Figure 2:
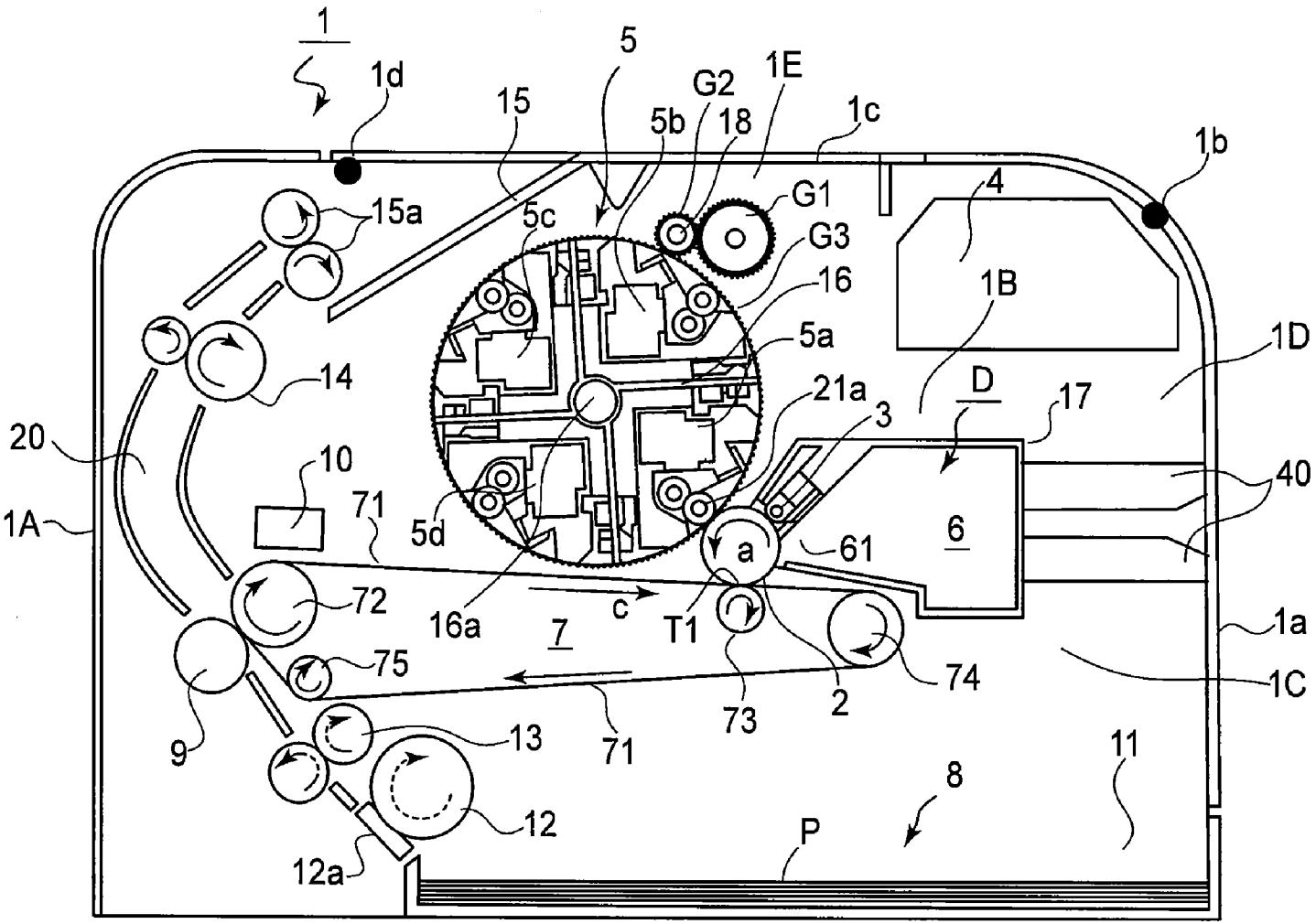
FIG. 2 is a general arrangement (a yellow developing device is in a developing position of the image forming apparatus) according to embodiment 1.

When the image formation starting signal is inputted, the control circuit portion starts a main motor (unshown) to start rotation of the drum 2. By driving the electric rotary driving mechanism, the gears G1, G2, G3 rotate the rotary member 16 by the predetermined angle in a clockwise direction b from a standby position angle shown in FIG. 1 about the axis of the central shaft 16*a*, and stop it there. The yellow developing device 5*a* is positioned to the developing position by a rotation of this rotary member 16 as shown in FIG. 2. In the developing position, relative to the drum 2, of the developing device of the present embodiment, a developing roller which is a developer carrying member for carrying and supplying the toner to the drum 2 is in contact to the drum 2. Designated by 21*a* is the developing roller of the yellow developing device 5*a*. As shown in FIG. 2, a driving force and a developing bias are applied from the main assembly (1A) side to the yellow developing device 5*a* having been moved to the developing position. In addition, the exposure means 4 as a laser scanner unit is driven. Furthermore, the belt 71 is driven. The secondary transfer roller 9 and belt cleaner 10 are held in the non-operative position spaced from the belt 71. A predetermined charging bias voltage is applied to the charging roller 3. By this, the rotated surface of the drum 2 is uniformly charged to the predetermined polarity potential. The laser scanner unit 4 outputs a laser beam modulated correspondingly to a Y color component image signal of the full-color image, the charged surface of the drum 2 is scanningly exposed to the laser beam thereof. By this, an electrostatic latent image corresponding to a Y color component image is formed on a drum surface. The electrostatic latent image is developed into a Y color toner image by the yellow developing device 5*a*. In this embodiment, the electrostatic latent image is reversely developed using the negative toner having the same polarity as the charge polarity of the drum 2. The yellow toner image is transferred (primary transfer) onto the surface of the belt 71 in the primary transfer nip portion T1. A primary transfer bias voltage having a predetermined potential of the polarity opposite the charge polarity of the toner is applied at the predetermined control timing to the primary transfer roller 73. The cleaning of the drum surface after the primary transferring is carried out by the cleaning blade 61.

When the primary transferring of Y color toner image onto the belt 71 finishes, the rotary member 16 is intermittently rotated by the predetermined angle clockwisely. By this, now, the magenta developing device 5*b* is moved to and positioned at the developing position. And, the charging, exposure and development steps for forming an M color toner image corresponding to an M color component image of the full-color image are carried out. The magenta toner image is superimposedly transferred (primary transfer) in registration with the yellow toner image already transferred onto the belt 71 in the primary transfer nip portion T1.

After the primary transferring of the M color toner image onto the belt 71, the rotary member 16 is intermittently rotated by the predetermined angle clockwisely. By this, the cyan developing device 5*c* is, then moved to and positioned at the developing position. And, the steps of the charging, exposure and development for forming a cyan toner image corresponding to a cyan component image are carried out. The cyan toner image is superimposedly transferred primarily in registration with the toner images of the yellow and the magenta already transferred onto the belt 71 in the primary transfer nip portion T1.

After the primary transfer of the cyan toner image onto the belt 71, the rotary member 16 is intermittently rotated by the predetermined angle clockwisely. By this, the black developing device 5*d* is then moved to and positioned at the developing position. And, the steps of charging, exposure and development for forming a black toner image corresponding to a black component image are carried out. The black toner image is superimposedly transferred (primary) in registration with the toner image of yellow, magenta, and cyan colors already transferred onto the belt 71 in the primary transfer position T1.

In this manner, on the belt 71, a full-color unfixed toner image of yellow, magenta, cyan, black colors is synthetically formed.

In addition, the order of colors of the color toner images formed on the drum 2 may not be limited to the order described above, but may be another proper order.

Figure 3:
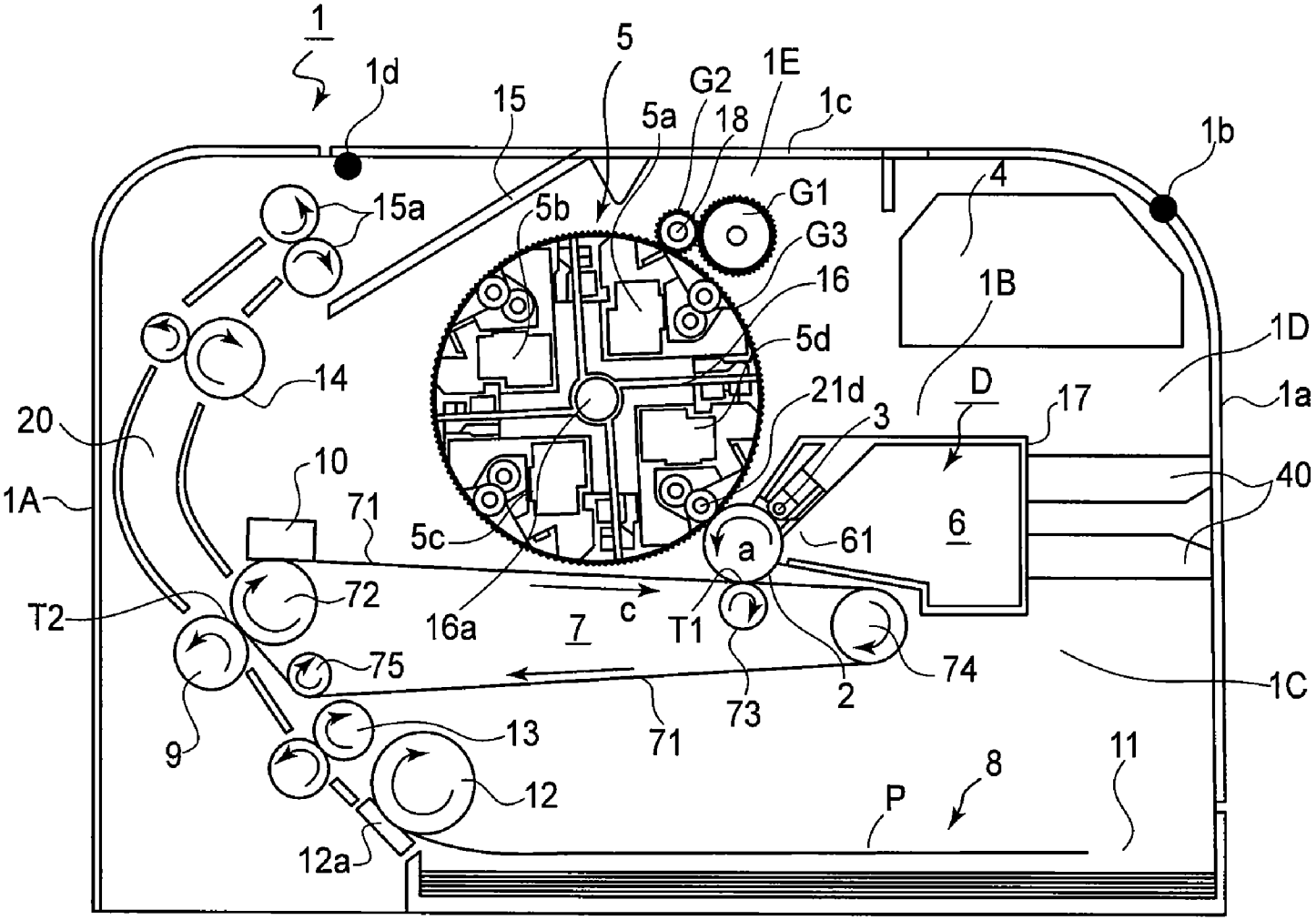
FIG. 3 is a general arrangement (a black developing device is in the developing position) of the image forming apparatus according to embodiment 1.

Before a leading end of the full-color unfixed toner image formed on the belt 71 reaches the position of the secondary transfer roller 9 by a movement of the belt 71, the secondary transfer roller 9 is moved to an operative position contacted to the belt 71. In addition, the belt cleaner 10 is moved to an operative position relative to the belt 71. FIG. 3 shows this state.

On the other hand, the sheet feeding roller 12 is driven at the predetermined control timing. By this, the recording materials P stacked in the sheet feeding cassette 11 are fed one by one by a cooperation of the sheet feeding roller 12 and the separation pad 12*a*. The recording material P is introduced at the predetermined control timing by the registration roller couple 13 into the secondary transfer nip portion T2 which is the contact portion between the secondary transfer roller 9 and the belt 71. A secondary transfer bias having a predetermined potential of the polarity opposite the charge polarity of the toner is applied to the secondary transfer roller 9. By this, in the process in which the recording material P is nipped and fed in the secondary transfer nip portion T2, the four-color toner image superimposed on the belt 71 is transferred all together onto the surface of a recording material P.

The recording material P is separated from the surface of the belt 71, and is introduced into the fixing device 14, where the transferred image is heated and pressed by a fixing nip. By this, the toner image is fixed on the recording material P (melting and color mixing). And, the recording material P is discharged out of the fixing device 14, and is discharged to the sheet discharge tray 15 by the sheet discharging roller pair 15*a* as a full-color print.

The untransferred toner which remains on the surface of the belt 71 after the recording material separation is removed by the belt cleaner 10.

More particularly, by rotating the rotary member 16 which supports the different color developing devices, one developing device is moved to the developing position opposed to the drum 2, and the latent image formed on the drum 2 is developed into a developer image by the developing device. These operations are sequentially carried out by the plurality of developing devices, and form the color image on the recording material P through an intermediary transfer member.

Or, when an image formation job for continuous sheets finishes, the control circuit portion returns the image forming apparatus 1 to the standby state shown in FIG. 1, and waits for the inputting of the next image formation starting signal. More particularly, the operations of the drum 2, the laser scanner unit 4 and the belt 71 are stopped. The secondary transfer roller 9 and the belt cleaner 10 are moved to the non-operative position.

In a monochromatic image formation mode, the image formation using only the black developing device 5*d* is carried out. Or, when a monochromatic image formation job for the continuous sheets finishes, the control circuit portion returns the image forming apparatus 1 to the standby state shown in FIG. 1, and waits for the inputting of the next image formation starting signal.

(Drum Cartridge Mounting and Demounting)

Figure 4:
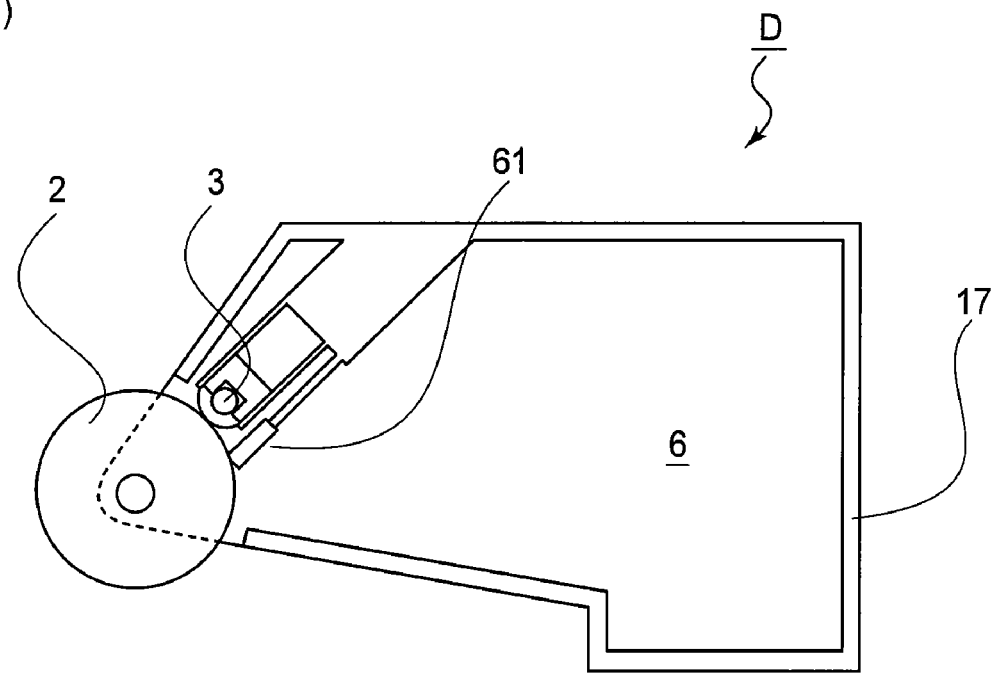
FIG. 4 shows a schematic sectional view (a), and a schematic perspective view (b) of a drum cartridge.
Figure 4:
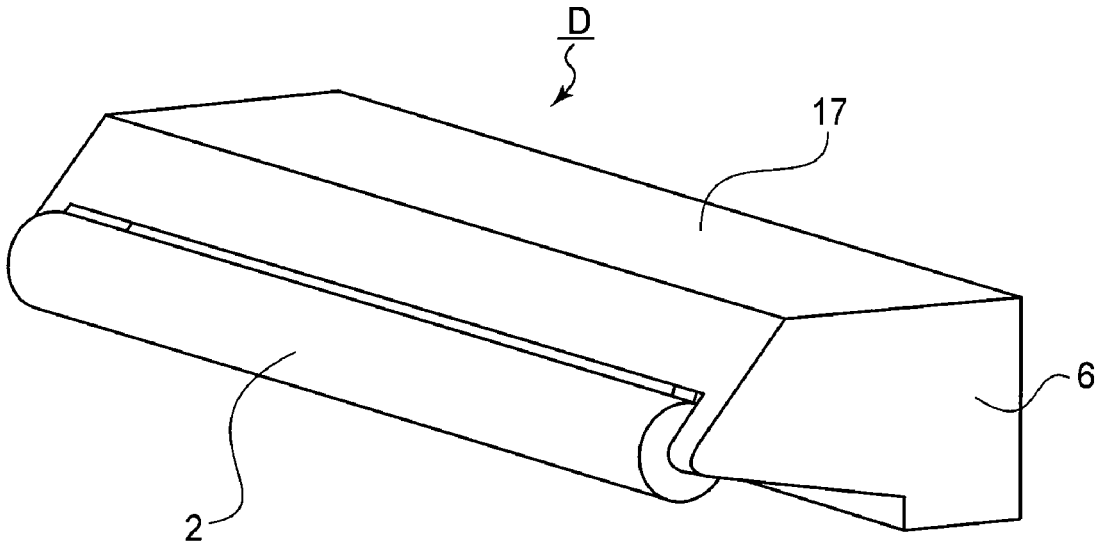

FIG. 4 is a schematic sectional view (a), and a schematic perspective view (b) of the drum cartridge D. In this embodiment, the drum cartridge D contains integrally the drum 2, the charging roller 3, and the cleaning means 6, and is detachably mountable to the main assembly 1A. When a part such as a drum 1 reaches the lifetime, and when an amount of the untransferred developer accommodated in the cleaning container 17 reaches a limit, for example, the image forming apparatus 1 can continuously be used by exchanging the drum cartridge D. The drum cartridge D comprises at least the drum 2 as the image bearing member, and it may include the process means, a feeding mechanism for feeding the untransferred developer to the rear side of the cleaning container 17 efficiently, and the like.

Figure 5:
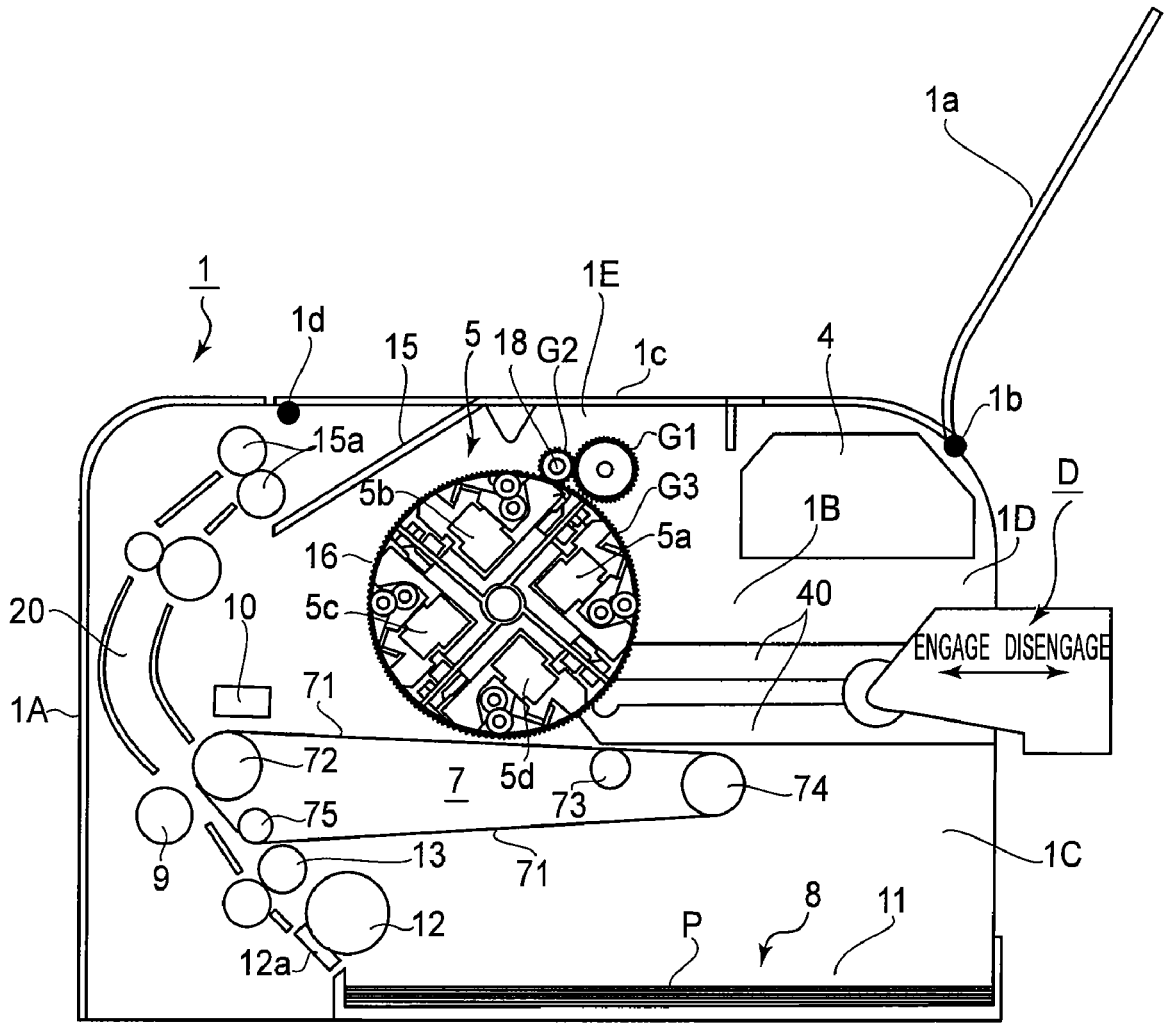
FIG. 5 is an illustration of a mounting and demounting process of a drum cartridge.

In this embodiment, the description will be made about the mounting and demounting of the drum cartridge D relative to the main assembly 1A. As shown in FIG. 5, in the mounting and dismounting operation of the drum cartridge D, a front cover 1*a* of the main assembly 1A is rotated about a hinge portion 1*b*, to open the inside of the main assembly 1A. When the cover 1*a* is opened, a drum cartridge mounting portion 1B in the main assembly 1A appears through an opening 1D. The left and right opposing wall portions of this mounting portion 1B is provided with guiding members 40 (mounting means) for guiding the drum cartridge D to inside and outside of the main assembly 1A. The left and right opposing side plates of a main frame 1C which is a frame of the main assembly 1A is provided with guiding members 40, respectively. In addition, a connection of a driving output portion (unshown) of the main assembly (1A) side to a driving input portion (unshown) of the drum cartridge D mounted to the mounting portion 1B is released by an interrelating mechanism (unshown) in interrelation with the open movement of the cover 1*a*. In addition, the anchoring of the drum cartridge D by a positioning and fixing means (unshown) of the main assembly (1A) side is released. In addition, the electrical conduction between an inputting contact (unshown) of the drum cartridge D and an output power contact (unshown) of the main assembly (1A) side is disconnected. By this, the removal of the drum cartridge D mounted to the main assembly 1A is permitted. In view of this, the user grips the rear side of the drum cartridge D (opposite side to the drum (2) side), pulls out the drum cartridge D along the guiding member 40, and takes it out to an outside of the main assembly 1A through the opening 1D.

The mounting of the drum cartridge D is carried out through a process in the order opposite the order described above. More particularly, the user grips the rear side of the drum cartridge D, and inserts it into the main assembly 1A through the opening 1D with the leading side at a front side (drum (2) side). Right and left portions to be guided (unshown) of the drum cartridge D are engaged with the left and right guiding members 40 of the main assembly (1A) side, respectively. The drum cartridge D is sufficiently pushed into a positioning portion of the mounting portion 1B along the guiding members 40. Then, the cover 1*a* is closed. By the interrelating mechanism interrelated with the closing movement of this cover 1*a*, the position of the drum cartridge D is determined by the moving and positioning means of the main assembly (1A). This position of the drum cartridge D positioned in this manner is a mount position. The driving output portion of the apparatus main assembly (1A) connects to the driving input portion of the drum cartridge D. In addition, the output power contact by the side of the main assembly (1A) is electrically connected to the inputting contact of the drum cartridge D. By this, the image forming apparatus 1 carries out the initial operation to enable the image forming operation.

(Developing Device and Mounting and Demounting Thereof)

Figure 6:
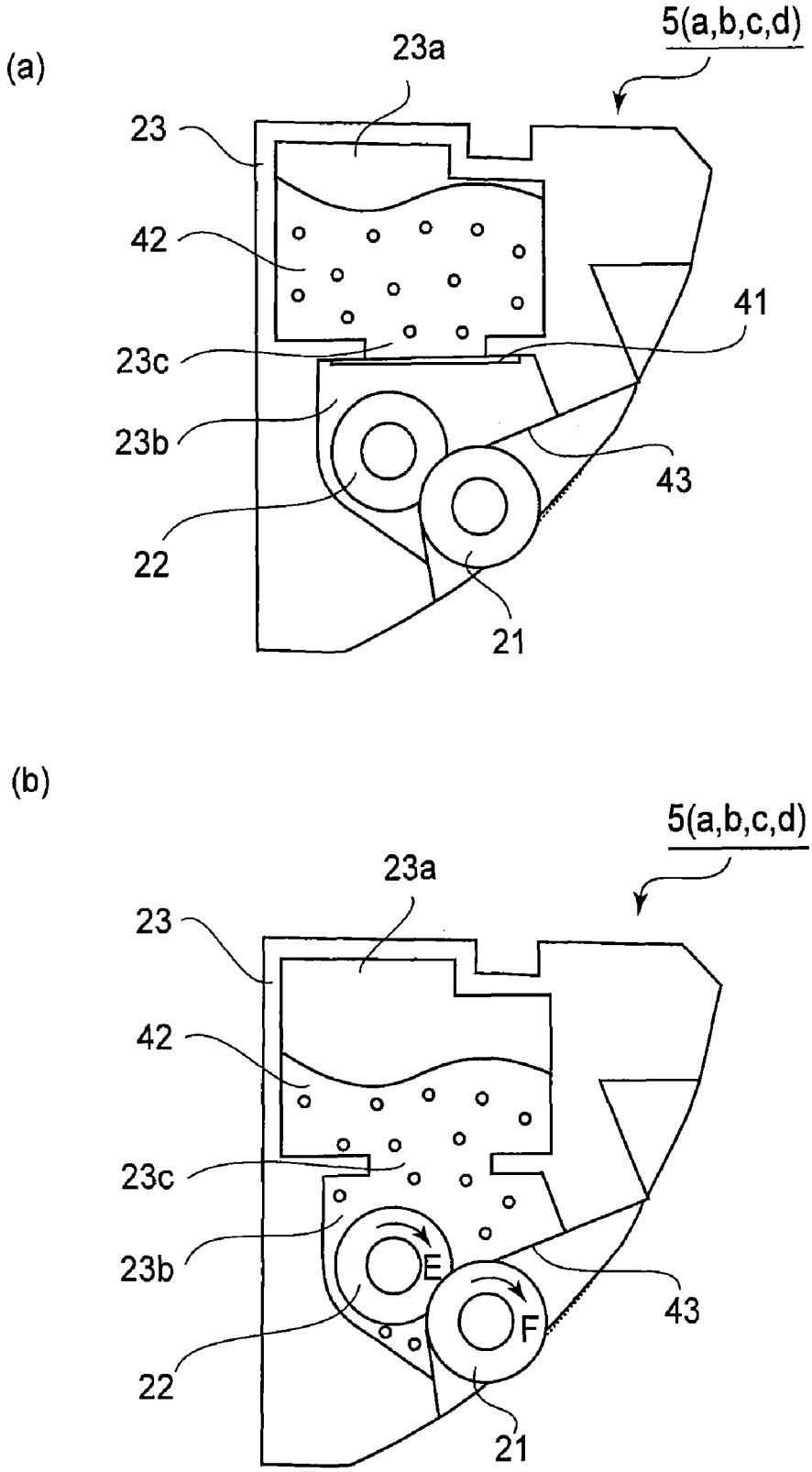
FIG. 6 is a schematic sectional view before the removal of a toner seal from a developing cartridge (a), and a schematic sectional view after the removal of the toner seal (b).

The yellow developing device 5*a*, the magenta developing device 5*b*, the cyan developing device 5*c*, and the black developing device 5*d* as the developing cartridges are set detachably to the predetermined mounting position of the rotary member 16. All the developing devices 5 (a, b, c, d) have the same structures, although the colors of the toner contained therein differ from one another. FIG. 6 is a schematic sectional view (a) of the developing device 5 before the removal of a toner seal 41, and a schematic sectional view (b) of the developing device after the removal of the toner seal 41.

A developer container 23 of the developing device 5 is provided with a developer accommodating chamber 23*a* and a developer chamber 23*b* which has a developing roller 21 and a developer supply roller 22, and a developer supply opening 23*c* is provided between the chambers 23*a*, 23*b*. As shown in (a) of FIG. 6, in an unused state until the developing device 5 reaches a user, the developer supply opening 23*c* is sealed by fixing a toner seal 41 of the shape of a film for separating between the developer accommodating chamber 23*a* and the developer chamber 23*b* to the developer container 23 by a method such as welding. By removing the toner seal 41 before the usage, a toner 42 in the developer accommodating chamber 23*a* enters the developer chamber 23*b*, as shown in (b). The developing device 5 from which the toner seal 41 is removed is mounted to the predetermined mounting position of the rotary member 16. In the state that the developing device 5 is positioned at the developing position, the driving force and the developing bias is received from the main assembly (1A) side. Therefore, by rotating in the direction of an arrow E, the developer supply roller 22 supplies the toner 42 to the developing roller 21. The developing roller 21 comprises an elastic rubber roller, and rotates in the direction indicated by an arrow F. The toner 42 on the developing roller 21 is regulated by a developing blade 43, and is supplied to the drum 2. The developing bias is applied to the developing roller 21. By this, the electrostatic latent image on the drum 2 is developed into a toner image. The toner 42 left on the developing roller 21 after the development is removed by the developer supply roller 22. Thereafter, the toner 42 is supplied to the developing roller 21 by the developer supply roller 22.

In addition, the developing device 5 includes at least the developing roller 21 as the developer carrying member for supplying the toner 42 to the drum 2, but various process means, various parts, and structures may be included.

With the execution of the image formation, the toner 42 contained in the developing device 5, (a, b, c, d) as the developing cartridge is consumed. The developing devices 5, (a, b, c, d) are provided with detecting means (unshown) for detecting a remainder amount of the toner thereof, respectively. In the control circuit portion, a remaining amount value detected by the detecting means is compared with the threshold for the developing device lifetime for notice, and the lifetime warning set beforehand. As to the developing device with which the remaining amount value has reduced to the level less than the threshold, a lifetime for notice and lifetime warning about the developing device is displayed on a display portion (unshown). By this, it prompts for the preparation of the developing device for the exchange, or for the exchange of the developing device.

Figure 7:
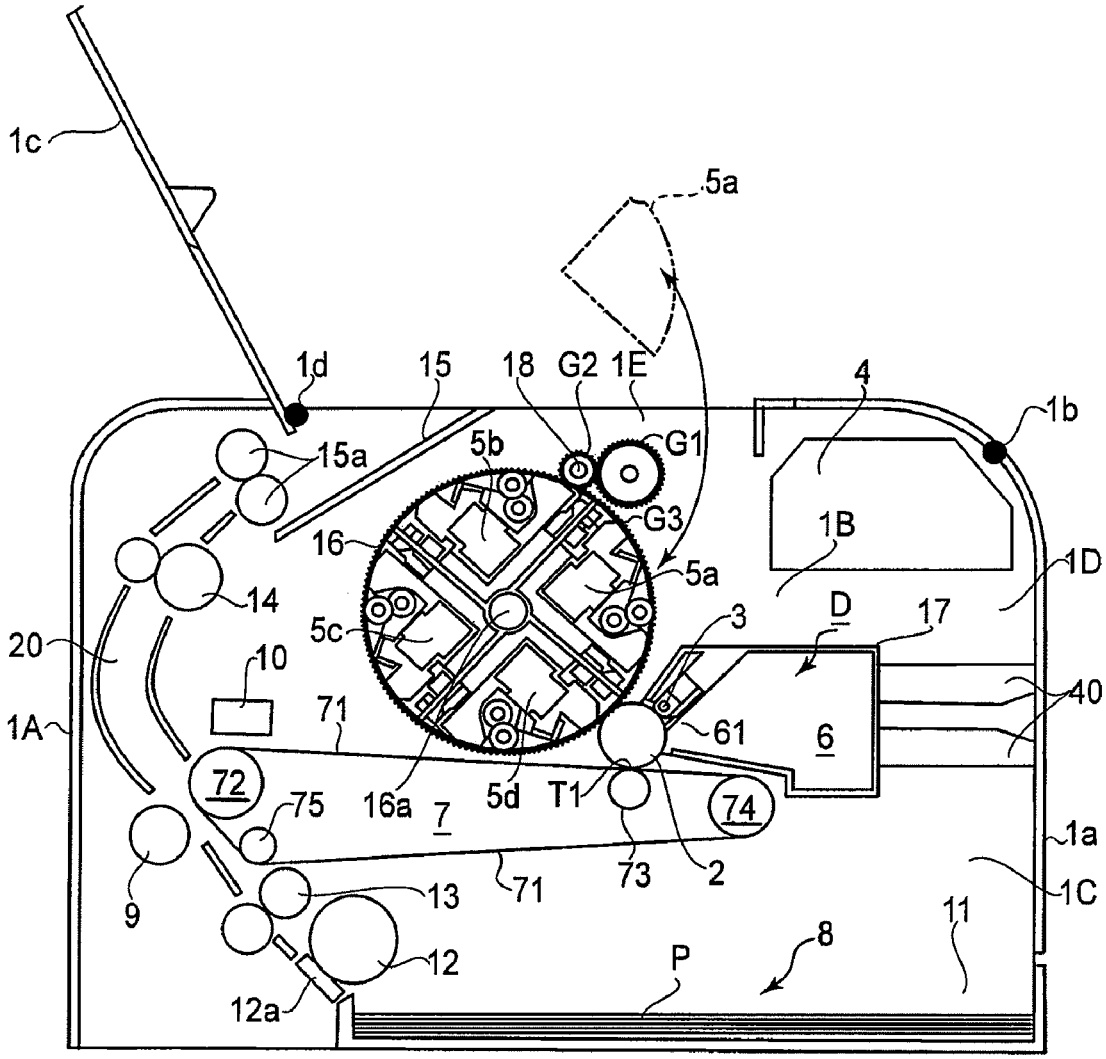
FIG. 7 is an illustration of the mounting and demounting process of the developing cartridge.

In this embodiment, the description will be made as to the mounting and demounting, relative to the main assembly 1A, of the developing device 5. More particularly, the developing device 5 becomes detachably mountable as shown in FIG. 7 by opening an upper surface cover 1*c* of the main assembly 1A about a hinge portion 1*d* to open the inside of the main assembly 1A. When the cover 1*c* is opened, a part of an upper side and the front side of the rotary member 16 in the main assembly 1A can be seen through an opening 1E. The developing device 5 which is in the front side of the rotary member 16 can be taken out of the rotary member 16 to the outside of the main assembly 1A through the opening 1E. On the contrary, the developing device 5 can be inserted into the main assembly 1A through the opening 1E, and can be mounted to the front side of the rotary member 16. The description about the means or the mechanism for the mounting and demounting of the developing device 5 relative to the rotary member 16 is omitted for simplicity. The rotary member 16 is rotated by an electric rotary driving mechanism or a manual mechanism (unshown) so that the developing device 5 which should be exchanged among the developing devices 5 mounted to the rotary member 16 stops at the front side of the rotary member 16. The developing device 5 is disengaged from the rotary member 16, and a new developing device 5 from which toner seal 41 is removed, is mounted to the rotary member 16. After the exchange of the developing device 5 is completed, the upper surface cover 1*c* is closed. In response to this, the image forming apparatus 1 is initialized, and the image forming operation is enabled.

(Rotary Member)

Figure 8:
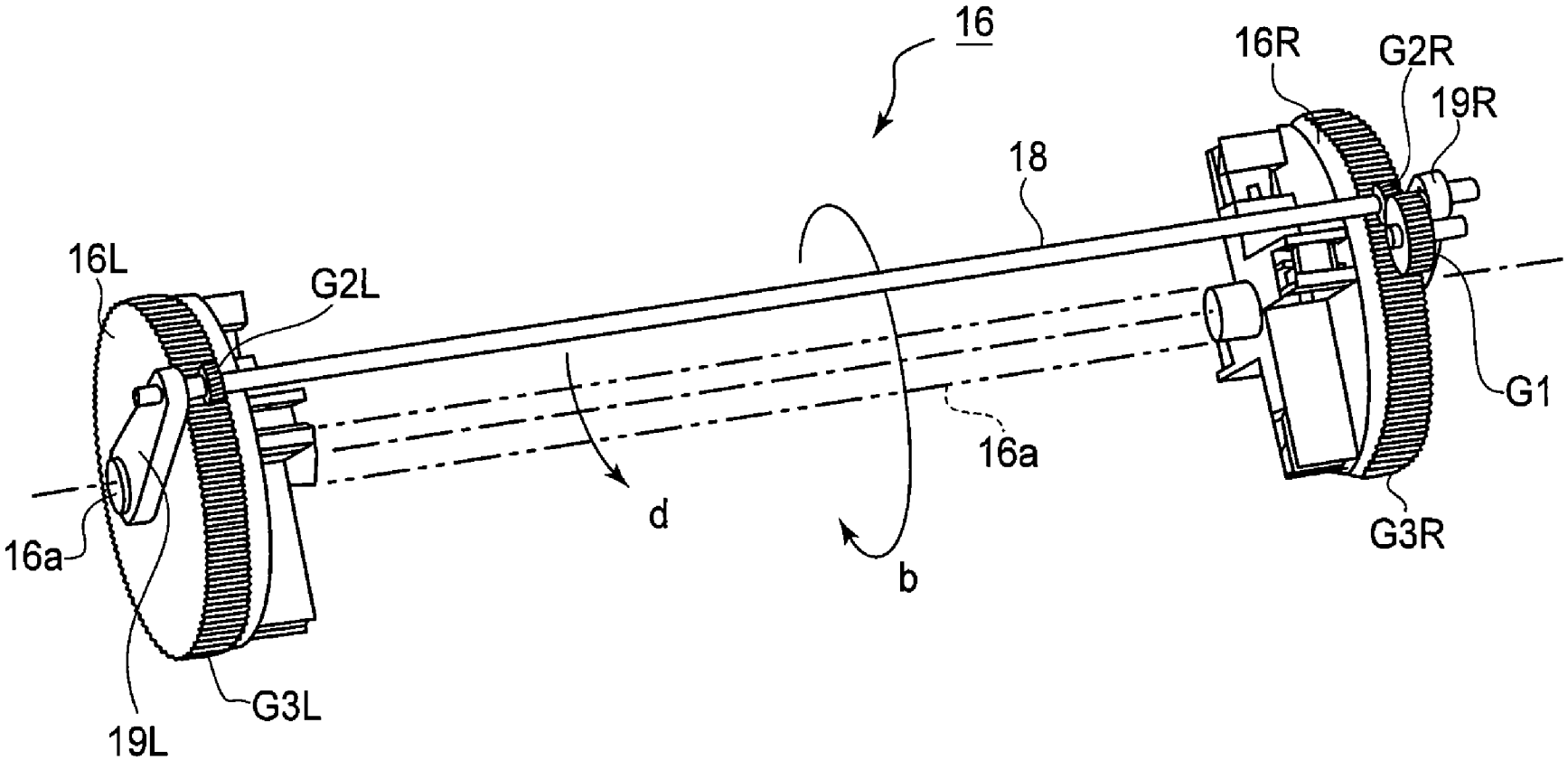
FIG. 8 is a schematic perspective view of a rotary member.

Referring to FIG. 8, the structure of the rotary member 16 according to the present embodiment will be described. The rotary member 16 includes the central shaft 16*a*, and a pair of disc-like side plates 16L, 16R concentrically and integrally mounted to the left and right end portions, respectively. The insides of the disc-like side plates 16L, 16R are provided with mounting portions for detachably supporting the longitudinal opposite ends of the developing devices 5*a*, 5*b*, 5*c*, and 5*d*. Between the left and right opposing side plates of the main frame 1C of the main assembly 1A, a swingable shaft 18 of a rotary member is mounted rotatably by bearing members (unshown). Each of the left and the right end portions of the swingable shaft 18 is provided with rotatable suspension arm members 19L, 19R. Between the left and right suspension arm members 19L, 19R, the central shaft 16*a* is supported rotatably at the left and right end portions to support the rotary member 16. The developing device 5*a*, 5*b*, 5*c*, 5*d* is mounted detachably in the predetermined mounting portion between the left and right disc-like side plates 16L, 16R of this rotary member 16. Outer peripheries of the left and right disc-like side plates 16L, 16R are formed into rotary member gears G3L, G3R, respectively. To the left and right portions of the swingable shaft 18, idler gears G2L, G2R are fixed, respectively. The left side idler gear G2L is in meshing-engagement with the left side rotary member gear G3L, and the right side idler gear G2R is in meshing-engagement with the right side rotary member gear G3R. The driving gear G1 driven by the electric rotary driving mechanism is provided on the right side plate side of the main frame 1C of the main assembly 1A, and is engaged with the right side idler gear G2R.

With the above described structure, when the driving gear G1 is rotated in the predetermined direction, a rotational force is transmitted to the right side rotary member gear G3R through the right side idler gear G2R. A rotational force of the driving gear G1 is transmitted to the left side rotary member gear G3R through the right side idler gear G2R, the swingable shaft 18 and the left side idler gear G2L. By this, the rotary member 16 is rotated in the clockwise direction indicated by the broken line arrow b in FIG. 1 about the central shaft 16*a*.

Figure 9:
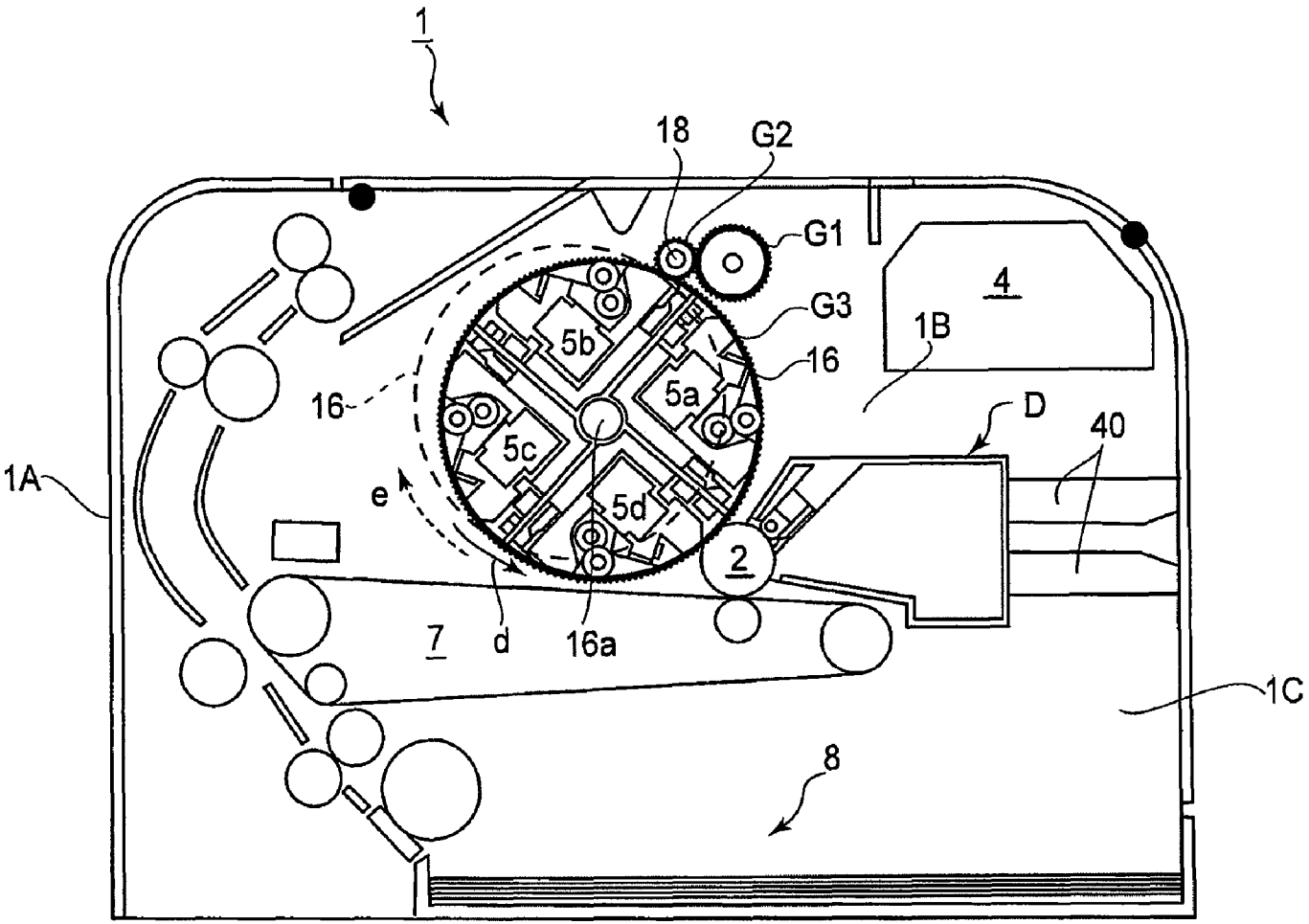
FIG. 9 is an illustration of a swinging operation of the rotary member.

In addition, since the rotary member 16 is hung through the left and right suspension arm members 19L, 19R on the swingable shaft 18, it is swingable in the counterclockwise direction indicated by an arrow d and in the clockwise direction indicated by an arrow e, about the swingable shaft 18 in FIG. 8 and FIG. 9. A swinging of the rotary member 16 in the counterclockwise direction d makes the rotary member 16 approach to the drum cartridge D (drum 2) which is in the mount position, and the swinging in the counterclockwise direction e keeps away the rotary member 16 from the drum cartridge D and (drum 2). The rotary member 16 is urged to the counterclockwise direction indicated by the arrow d about the swingable shaft 18 by an urging member (unshown) such as a spring. By this urging, the rotary member 16 is held in the state of being in abutment to the drum cartridge D mounted and positioned to the mount position in the main assembly 1A in FIG. 9 (first position indicated by the solid lines. In the first position, the developing roller 21 of the developing device 5 moved to the developing position by a rotation control of the rotary member 16 contacts uniformly to the drum 2 of the drum cartridge D. More particularly, the developing roller 21 is in contact with the predetermined pressure to the drum 2. Here, the developing roller 21 may not be directly contacted to the drum 2, and a predetermined small gap may be provided between the developing roller 21 and the drum 2 by spacer rollers provided at the longitudinal opposite ends of the developing roller 21 contacting to the longitudinal opposite ends of the drum 2. In addition, when the rotary member 16 is pushed in a clockwise direction e against an urging force of the urging member, it is moved to the second position (a broken line in FIG. 9) spaced by a predetermined distance from the drum cartridge D.

Here, since the right and left idler gears G2L, G2R engaged with the right and left rotary member gears G3L, G3R of the rotary member 16 are provided concentrically with the swingable shaft 18 of the rotary member 16, engagement therebetween is maintained even if the rotary member 16 swings between the first position and the second position.

(Cover Member of Drum Cartridge D)

In shipping and transporting the drum cartridge D, it is desirable that a surface damage of the drum 2 and the influence contributable to the image defect are prevented. In addition, in shipping and transporting the image forming apparatus 1, it is desirable that the developing roller 21, the charging means 3, the belt 71 and the like contacted to the drum 2 at the time of an image formation is spaced physically and no tension is imparted. Furthermore, it is desirable that a user releases the spacing and imparts the tension at the time of an unpacking of the image forming apparatus 1. More particularly, it is desirable that a contact type charging means 3 is physically spaced from the drum 2 at the time of the shipping and the transportation. By this, since the deformation of the charging means 3 itself by a contact state continuing for a long time can be prevented, a satisfactory image can be produced at the time of the image formation.

Figure 10:
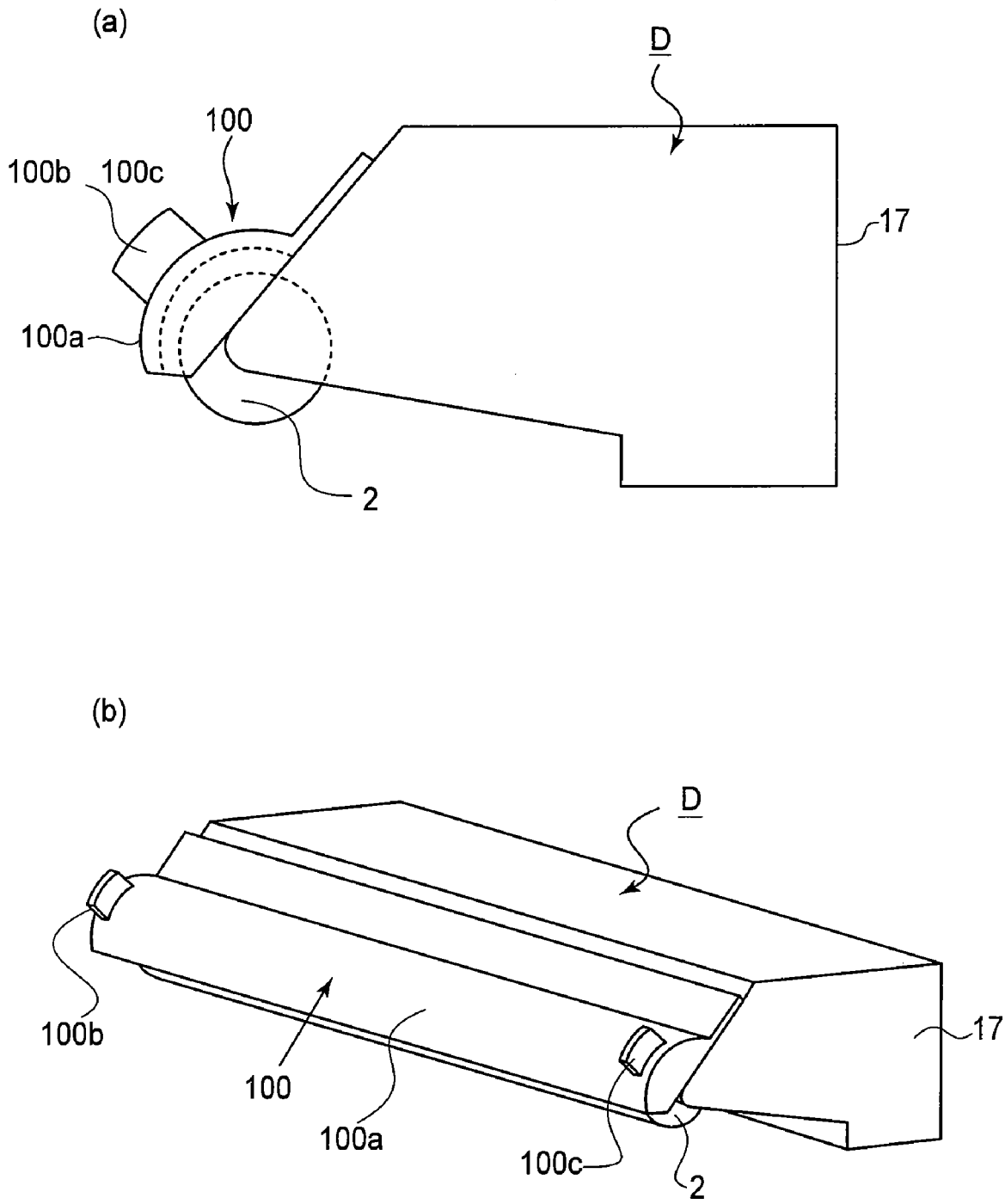
FIG. 10 is a schematic side view (a) of the drum cartridge in the state of being provided with a cover member, and a schematic perspective view (b) thereof.
Figure 11:
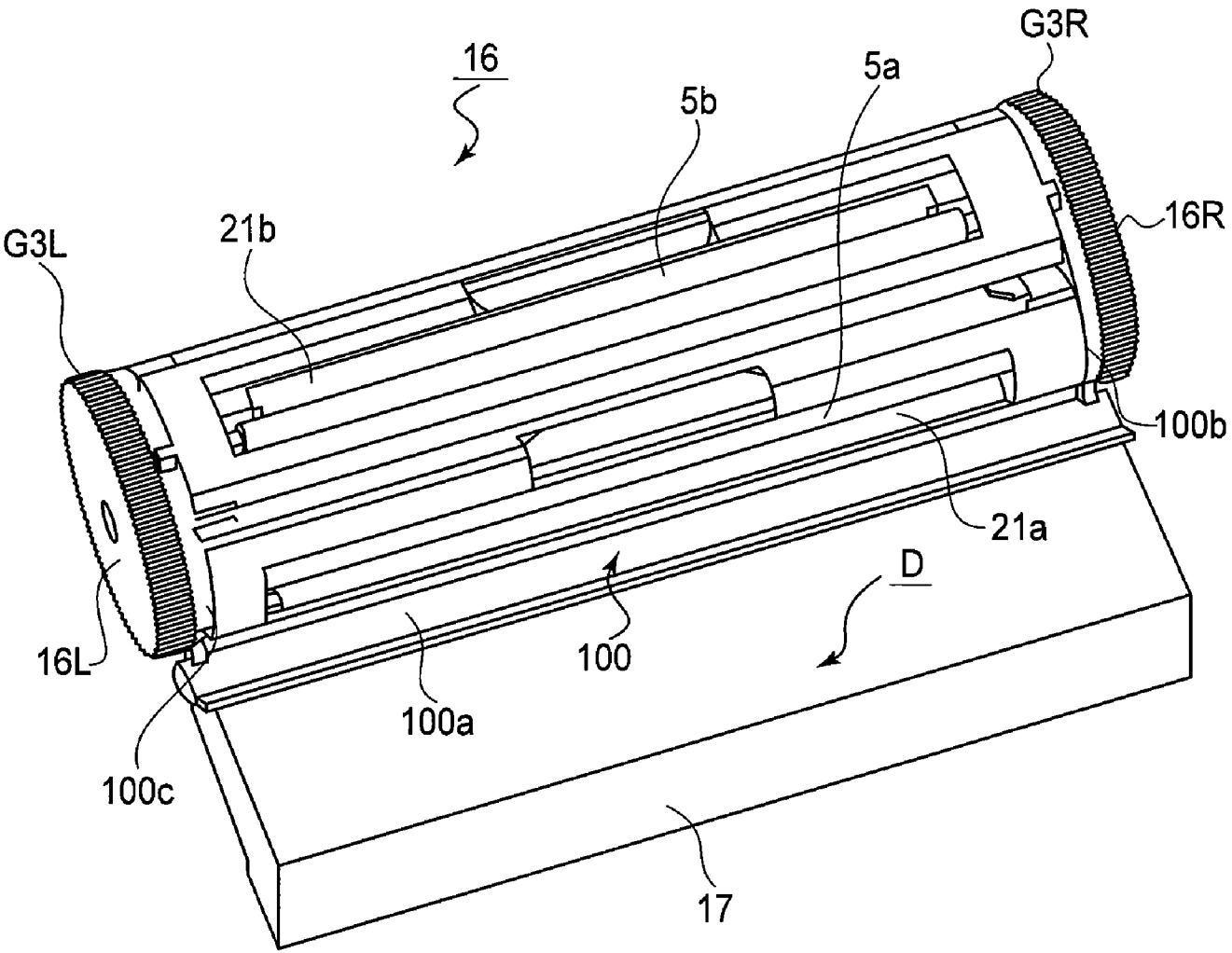
FIG. 11 is a schematic perspective view of a rotary member and the drum cartridge to which the cover member is mounted.
Figure 12:
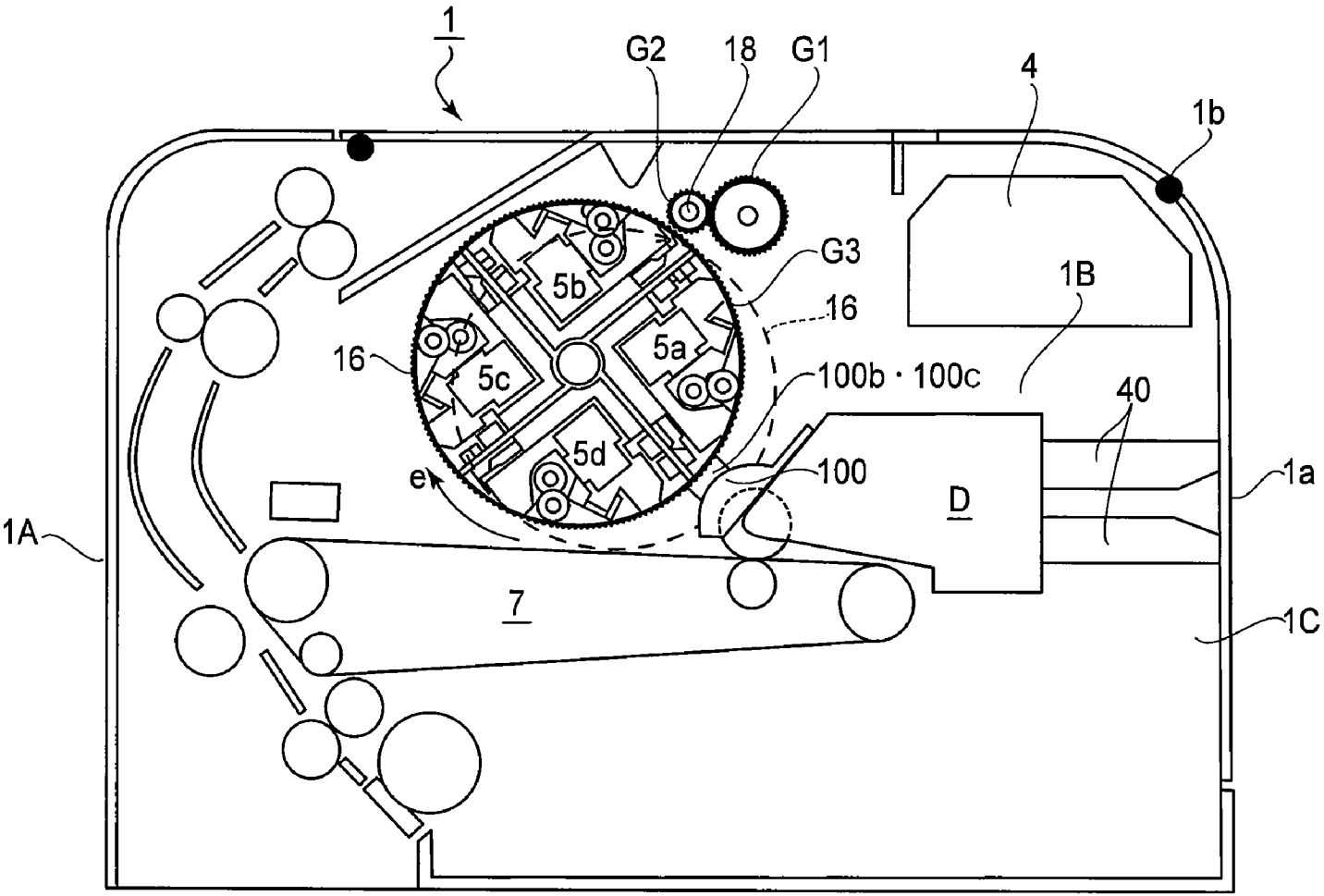
FIG. 12 is an illustration of the swinging operation, to a second position, of the rotary member at the time of mounting the drum cartridge, which is provided with the cover member, to a main assembly.

In this embodiment, in shipping and transporting the drum cartridge D, a cover member 100 for protecting the drum 2 is mounted to the drum cartridge D. FIG. 10(*a*) is a schematic side view of the drum cartridge D in the state protected by the cover member 100, and FIG. 10(*b*) is a schematic perspective view thereof. FIG. 11 is a schematic perspective view showing only a rotary member 16 and the drum cartridge D to which the cover member 100 is mounted in the main assembly 1A, for illustrating a relation between the cover member 100 mounted to the drum cartridge D and the rotary member 16. FIG. 12 is a schematic sectional view illustrating the swinging of the rotary member 16 to the second position at the time of the drum cartridge D protected by the cover member 100 being mounted to the main assembly 1A.

The cover member 100 is provided with a protecting portion 100*a* for protecting the drum 2 and rotary member pressing portions (spacer members) 100*b*, 100*c* provided in the left end portion and the right end portion. In the state that the cover member 100 is mounted to the drum cartridge D, the protecting portion 100*a* covers an externally exposed surface of the drum 2. In the state that the cover member 100 is mounted to the drum cartridge D, the rotary member pressing portions 100*b*, 100*c* project in the direction away from the drum surface at longitudinal opposite end portions of the drum 2.

In the state that the cover member 100 is mounted, the drum cartridge D is mountable to the mount position of the main assembly 1A. FIG. 12 shows such a mounted state. By closing the front cover 1*a*, the drum cartridge D is positioned by the positioning fixing means of the main assembly (1A) at the mount position. In this state, the left and right rotary member pressing portions 100*b*, 100*c* of the cover member 100 are provided in the position corresponding to the left and right disc-like side plates 16L, 16R of the rotary member 16, respectively, and press the left and right disc-like side plates 16L, 16R against the urging member of the rotary member 16. By this, the rotary member 16 swings from the first position indicated by the broken lines which is the position at the time of the image formation to the second position indicated by the solid lines about the swingable shaft 18, and is maintained at this position. More particularly, the rotary member pressing portions 100*b*, 100*c* of the cover member 100 mounted to the drum cartridge D press a part of right and left disc-like side plates 16L, 16R of the rotary member 16 by which the rotary member 16 is moved from the first position to the second position. The swinging of the rotary member 16 is restricted in the second position so that the deformation, damage by the collision between the rotary member 16 and a rotary member peripheral portion can be prevented.

In addition, in this embodiment, the left and right disc-like side plates 16L, 16R of the rotary member 16 are pressed by the rotary member pressing portions 100*b*, 100*c* of the cover member 100, but the rotary member 16 may be moved to the second position by another means. For example, only one of the rotary member pressing portions 100*b*, 100*c* may be provided.

In the present embodiment, the structure of an interface part (contact portion between the drum 2 and the intermediary transfer member 71) and the like between the drum cartridge D, and the main assembly 1A may be a conventional structure. However, there is a possibility that the rotary member 16 which is a moving element of the image forming apparatus 1 may be deformed and damaged due to vibration during the transportation and the like. In consideration of this, as described above, the rotary member 16 is pressed to the second position using the rotary member pressing portions 100*b*, 100*c* provided on the cover member 100, by which the swinging of the rotary member 16 is restricted.

Furthermore, the cover member 100 is provided with the rotary member pressing portions 100*b*, 100*c* for restricting the swinging of the rotary member 16. By this, for example, when the drum cartridge D is taken out of the main assembly 1A, the drum 2 is protected until the cover member 100 is removed. In addition, the rotary member pressing portions 100*b*, 100*c* can be simultaneously dismounted by removing the cover member 100, and therefore, a set-up operation required of the user can be reduced.

In summary, the drum cartridge D is detachably mountable to the main assembly 1A of the image forming apparatus 1 which has the rotary member 16 which is swingable relative to the main assembly 1A in order to support and rotate a plurality of developing devices 5*a*, 5*b*, 5*c*, and 5*d* and to sequentially bring the developing device 5 to the developing position. The drum cartridge D has an electrophotographic photosensitive drum 2. In addition, it has the dismountable spacer members 100*b*, 100*c* for moving the rotary member 16 in the direction away from the drum 2 by abutting to the rotary member 16 when the drum cartridge D is mounted to the main assembly 1A. The spacer members 100*b*, 100*c* are provided on the cover member 100 for protecting the drum 2.

(Type at the Time of Shipping and Transportation, and Set-Up at the Time of Unpacking)

A description will be made as to the structure with which the drum cartridge D is packed in the main assembly 1A, and is shipped, and is transported, and is set up at the time of unpacking.

As has been described with respect to FIG. 10-FIG. 12, the drum cartridge D is mounted to the mount position of the main assembly 1A in the state that the cover member 100 which is provided with the rotary member pressing portions 100*b*, 100*c* as the spacer member is mounted. By this, the rotary member 16 is in the state of maintaining at the second position that the swinging is regulated. This state is the type at the time of a shipping of the image forming apparatus 1. By the rotary member pressing portion 100*b*, 100*c* of the cover member 100 advancing in the direction of decreasing a swinging stroke of the rotary member 16, the swinging of the rotary member 16 is restricted, so that the deformation, and/or damage of the rotary member 16 due to the vibration at the time of the transportation and the like can be prevented. Furthermore, the cover member 100 mounted to the drum cartridge D may also carry out another way of the locking at the time of shipping, such as means for releasing the tension of the belt 71.

Figure 13:
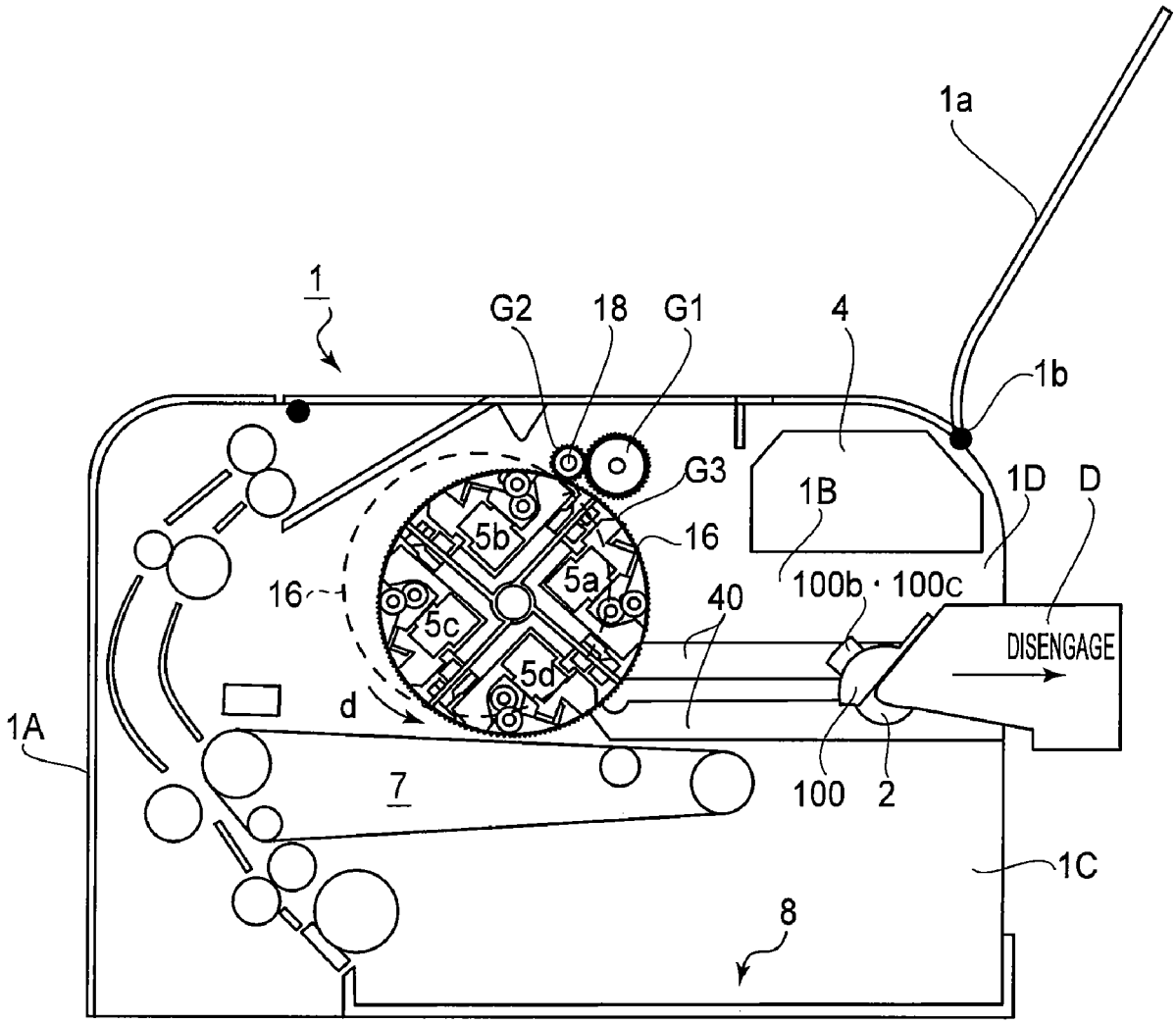
FIG. 13 is an illustration of a process of the taking-out of the drum cartridge to which the cover member is mounted.

When the user unpacks, and sets up the image forming apparatus 1 in the state of FIG. 12, the user opens the front cover 1*a* of the image forming apparatus 1, as shown in FIG. 13. By the interrelating mechanism (unshown) in interrelation with the opening movement of the cover 1*a*, the connection between the driving input portion of the drum cartridge D mounted to the mount position of the mounting portion 1B and the driving output portion (unshown) of the main assembly (1A) is released. In addition, the positioning and anchoring of the drum cartridge D by the positioning fixing means of the main assembly (1A) is released. Furthermore, the electrical connection between the inputting contact of the drum cartridge D and the output power contact of the main assembly (1A) is broken. By this, the removal of the drum cartridge D with the cover member 100 mounted to the mount position of the main assembly 1A is permitted. In view of this, the user grips the rear side of the drum cartridge D, pulls out the drum cartridge D with the cover member 100 along the guiding member 40, and once takes out the main assembly 1A through the opening 1D. By the drum cartridge D with the cover member 100 being taken out, the rotary member 16 is released from the pressing by the rotary member pressing portions 100*b*, 100*c* of the cover member 100. For this reason, the rotary member 16 is moved toward the first position indicated by the solid lines about the swingable shaft 18 from the second position (position of the indicated by broken line) as shown by the arrow d.

The cover member 100 is dismounted from the removed drum cartridge D. As has been described with respect to FIG. 5, the user grips the rear side of the drum cartridge D, and inserts the drum cartridge D into the main assembly 1A through the opening 1D with the leading end being the front side (drum (2) side). The right and left portions to be guided of the drum cartridge D are engaged with the right and left guiding members 40 by the side of the main assembly (1A), respectively. The user pushes the drum cartridge D into the mounting portion 1B along the guiding member 40, and the user sufficiently pushes the drum cartridge D in until the drum cartridge D is caught by the positioning portion. Then, the user closes the cover 1*a*, FIG. 1. By the interrelating mechanism in interrelation with the closing movement of this cover 1*a*, the drum cartridge D is set in the mount position by the positioning fixing means of the main assembly (1A). The driving output portion of the main assembly (1A) is connected with the driving input portion of the drum cartridge D. In addition, the output power contact of the main assembly (1A) is electrically connected with the inputting contact of the drum cartridge D. In this manner, a set-up of the drum cartridge D is completed. And, when the image forming apparatus 1 actuates in a voltage source, the initial operation is carried out, and the image forming operation is enabled.

As has been described hereinbefore, in shipping the image forming apparatus 1, in the state that the drum cartridge D is packed in the main assembly 1A, the drum cartridge D is packed in the main assembly 1 (FIG. 12) with the cover member 100 which covers the drum 2. By the spacer members 100*b*, 100*c* of the cover member 100 mounted to the drum cartridge D pressing a part of rotary member 16, the rotary member 16 is moved to the second position from the first position. In the second position, the swinging of the rotary member 16 is restricted, and therefore the deformation and damage attributable to the collision between the rotatable supporting member and a rotatable supporting member peripheral portion are prevented.

Embodiment 2

Referring to FIG. 14-FIG. 19, a description will be made about the packing and the set-up operation in embodiment 2. In this embodiment, the structure of the drum cartridge D is similar to that of the embodiment 1, but the structure of the cover member 100 and the form at the time of the shipping, transportation are different.

Figure 14:
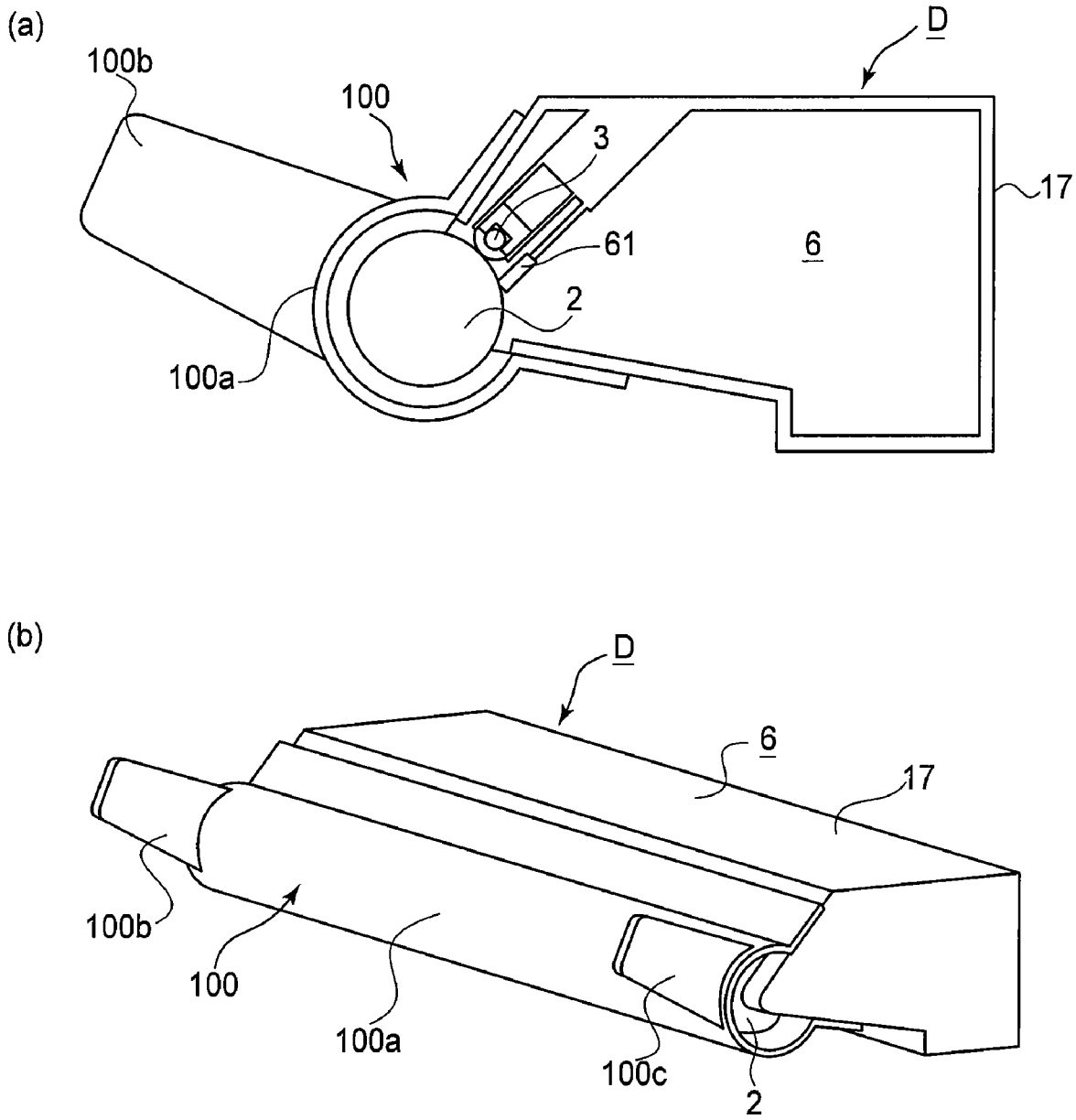
FIG. 14 is a schematic sectional view (a) of the drum cartridge in the state to which the cover member is mounted, according to embodiment 2, and a schematic perspective view (b) thereof.
Figure 15:
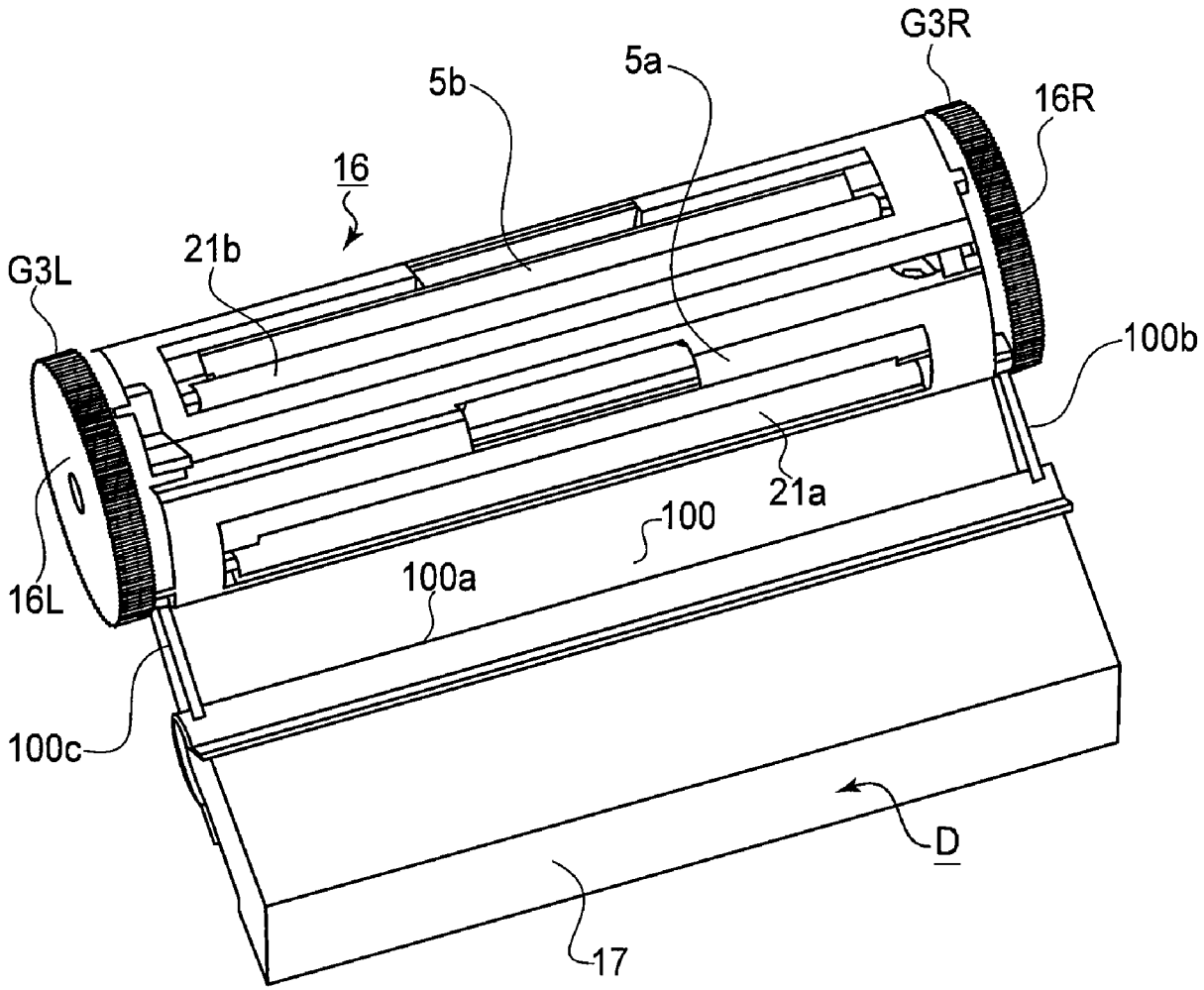
FIG. 15 is a schematic perspective view of the rotary member and the drum cartridge to which the cover member is mounted according to embodiment 2.
Figure 16:
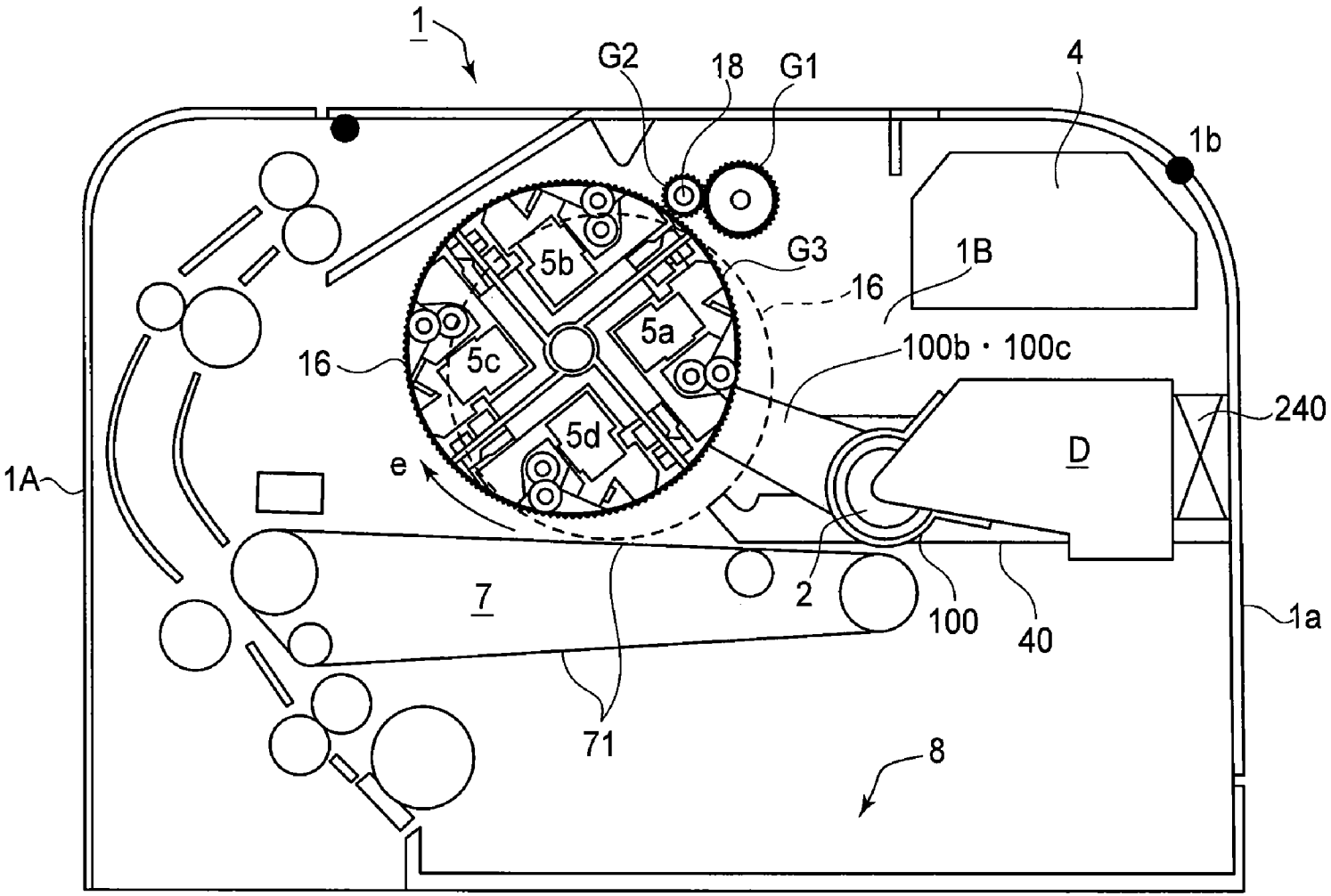
FIG. 16 shows a schematic sectional view of the image forming apparatus in the state that the drum cartridge to which the cover member is mounted according to embodiment 2 is mounted to the main assembly.

FIG. 14 is a schematic sectional view (a) and a schematic perspective view (b) of the drum cartridge D which has the cover member 100 in the present embodiment. In addition, FIG. 15 is a schematic perspective view only illustrating the rotary member 16 and the drum cartridge D which has the cover member 100 in the main assembly 1A in order to illustrate the relation between the cover member 100 mounted to the drum cartridge D and the rotary member 16. FIG. 16 is a schematic sectional view illustrating the swinging of the rotary member 16 to the second position at the time of the drum cartridge D which has the cover member 100 being inserted into the main assembly 1A.

The cover member 100 in the present embodiment is provided with a protecting portion 100*a* for protecting the drum 2 and the rotary member pressing portions (spacer members) 100*b*, 100*c* at the left and right end portions. In the state that the cover member 100 is mounted to the drum cartridge D, the protecting portion 100*a* covers the externally exposed surface of the drum 2. In addition, the rotary member pressing portion 100*b*, 100*c* projects away from the drum surface at the longitudinal opposite end portions of the drum 2 in the state that the cover member 100 is mounted to the drum cartridge D.

In this embodiment, the projecting length of the rotary member pressing portions 100*b*, 100*c* as the spacer member is longer than the projecting length of the rotary member pressing portions 100*b*, 100*c* of the cover member 100 of embodiment 1.

Figure 17:
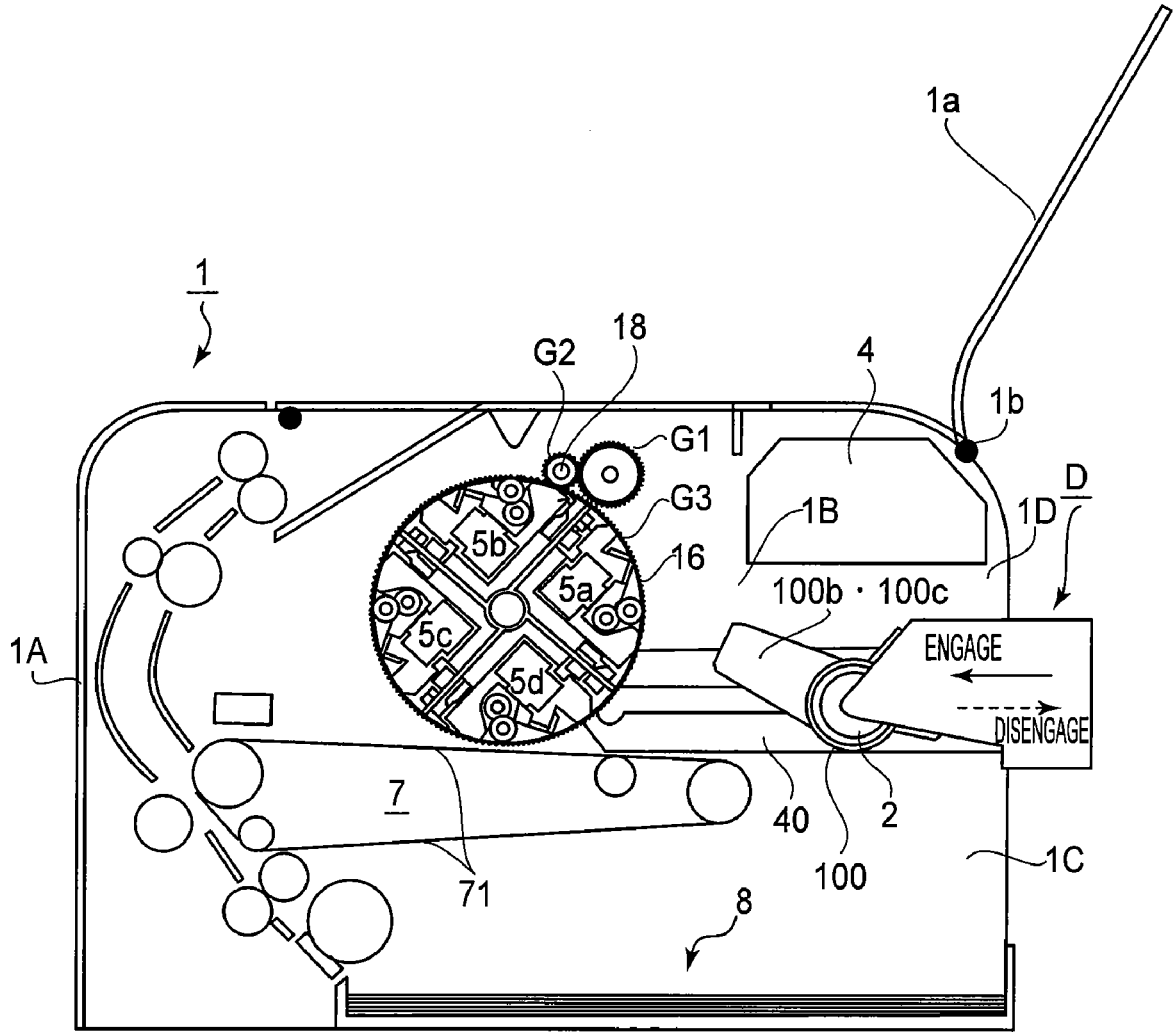
FIG. 17 is an illustration (type 1) of a process of mounting, to the main assembly, of the drum cartridge to which the cover member is mounted.
Figure 18:
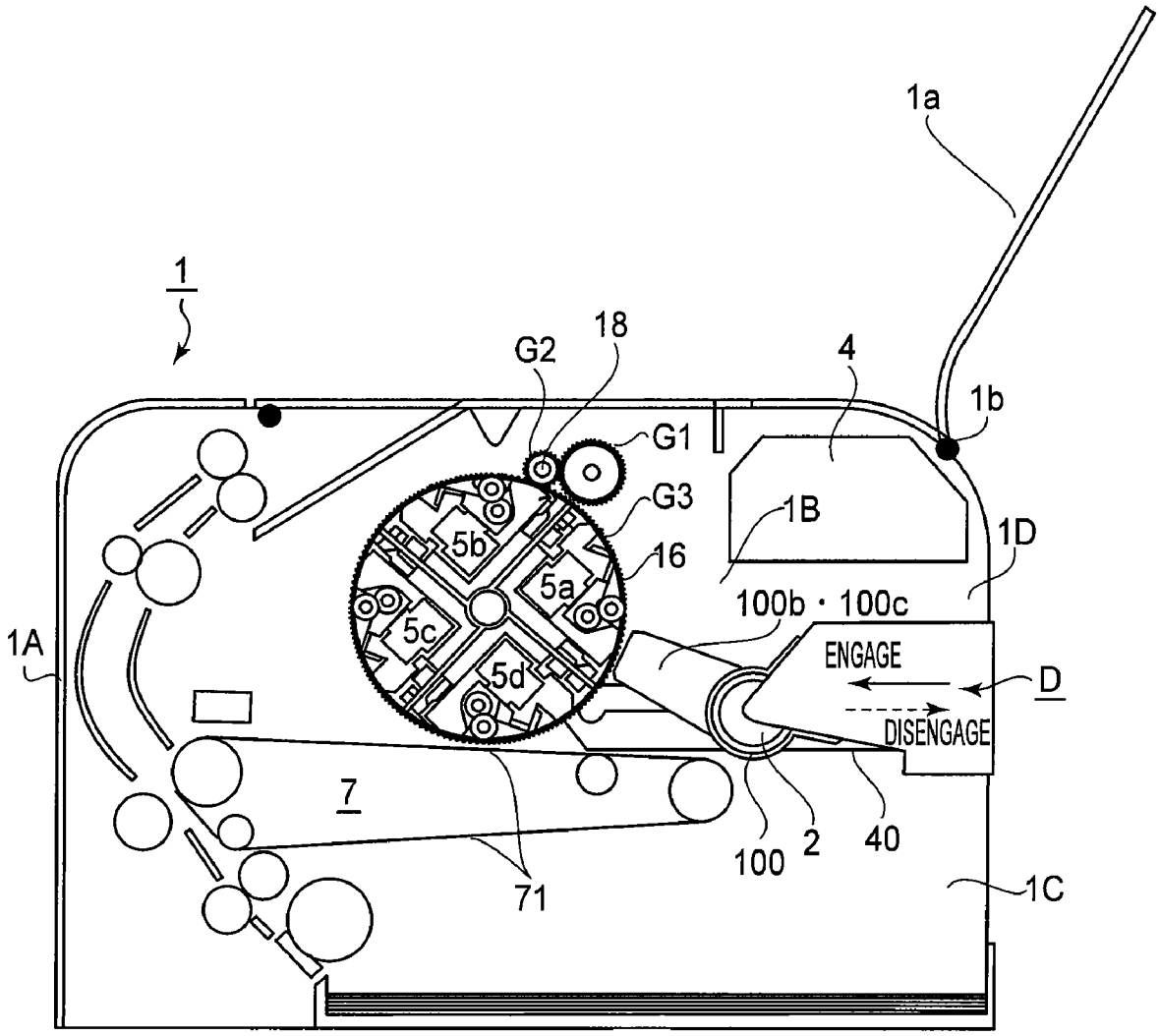
FIG. 18 is an illustration (type 2) of the process of mounting, to the main assembly, of the drum cartridge to which the cover member is mounted.
Figure 19:
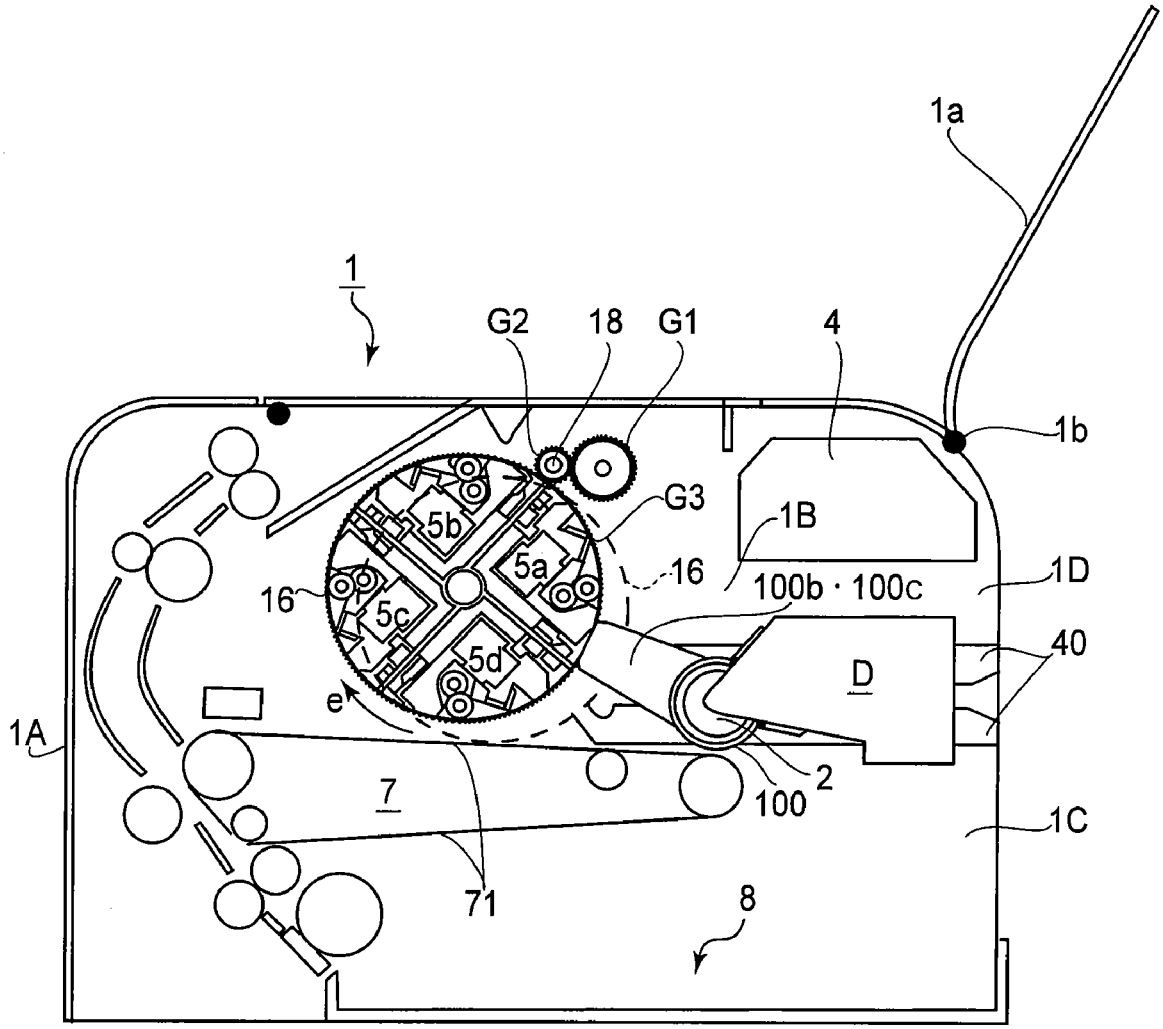
FIG. 19 is an illustration (type 3) of the process of mounting, to the main assembly, of the drum cartridge to which the cover member is mounted.

The drum cartridge D which has the cover member 100 of the present embodiment being packed at the time of the shipping of the image forming apparatus 1 will be described. As shown in FIG. 17, the drum cartridge D which has the cover member 100 is inserted into the main assembly 1A along the guiding member 40 through the opening 1D provided by opening the front cover 1*a*. Since the projecting length of the rotary member pressing portions 100*b*, 100*c* is long, the rotary member pressing portions 100*b*, 100*c* abut to the left and right disc-like side plates 16L, 16R of the rotary member 16 moved toward the first position in the course of the insertion of the drum cartridge D, as shown in FIG. 18. When the drum cartridge D is further inserted against the urging force of the urging member of the rotary member 16, the rotary member 16 swings from a first position in FIG. 17 to the second position (FIG. 19) for regulating the swinging in the image forming apparatus 1 about the swingable shaft 18. And, a further insertion of the drum cartridge D is prevented. More particularly, before the drum cartridge D is caught by the predetermined positioning portion of the mounting portion 1B, the insertion movement thereof is prevented. In view of this, a cushion member 240 is inserted between the rear side of the drum cartridge D, and the inner surface of the front cover 1*a*, and the front cover 1*a* is closed, as shown in FIG. 16. By this, the rebounding movement of the drum cartridge D by a reaction force of the urging member of the rotary member 16 is absorbed by the cushion member 240 and the front side door 1*a*. In the second position, the motion of the rotary member 16 in the case of the shipping and transportation of the image forming apparatus 1 is suppressed, so that the deformation and damage attributable to the collision between the rotary member 16 and the rotary member peripheral portion can be prevented. In addition, before the drum cartridge D is caught by the predetermined positioning portion of the mounting portion 1B, the insertion movement thereof is prevented, and it is maintained in that position. In this position, the drum 2 is spaced from an intermediary transfer belt 71, an electrical contact portion, the driving input portion and the like, and therefore, the damage attributable to the rubbing attributable to the vibration at the time of the transportation of the image forming apparatus 1 and the like can be prevented.

More particularly, in the form at the time of the shipping, the rotary member pressing portions 100*b*, 100*c* of the cover member 100 are pushed in the direction of decreasing the swinging stroke of the rotary member 16. This restricts a rotation of the rotary member 16, and prevents the deformation and damage of the rotary member 16 attributable to the vibration and the like at the time of the transportation.

In the state that the drum cartridge D is in the position in the course of entering toward the mounting portion 1B along the guiding member 40 the image forming apparatus 1 is shipped. In the drum cartridge D, the drum 2 is physically spaced from the intermediary transfer belt 71, the electrical contact, drive input portion and the like, and therefore, in the position taken in the course of an insertion, the damage which may result from the rubbing attributable to the vibration at the time of the transportation and the like can be prevented.

In summary, the mount position (FIG. 16) in which the drum cartridge D to which the spacer members 100*b*, 100*c* are mounted is mounted to the main assembly 1A as follows. It is the upstream side of the mount position (FIG. 9) of the drum cartridge D in the state that the rotary member pressing portions 100*b*, 100*c* which are the spacer members are dismounted, in the mounting direction for mounting the drum cartridge D to the main assembly 1A. And, it is a position (FIG. 16) spaced from the intermediary transfer member 71 onto which the image is transferred from the drum 2 provided to the main assembly 1A. The intermediary transfer member 71 and the drum cartridge D can be spaced from each other, and therefore, damage of the intermediary transfer member 71 and the drum 2 attributable to the vibration at the time of the transportation and the like, can be prevented. The surface damage and the image defect due to the rubbing at the time of the transportation of the drum 2, and the intermediary transfer member 71 can be prevented.

As shown in FIG. 16, when the user unpacks, and sets up the image forming apparatus 1 which has been packed and shipped with the drum cartridge D, the front cover 1*a* is opened. The cushion member 240 which interposes between the rear side of the drum cartridge D and the inner surface of the front cover 1*a* is removed. The user grips the rear side of the drum cartridge D, and pulls out the drum cartridge D with the cover member 100 along the guiding member 40, by which it is once taken out of the main assembly 1A through the opening 1D. By the drum cartridge D with the cover member 100 being taken out, the rotary member 16 is released from the rotary member pressing portions 100*b*, 100*c* of the cover member 100. For this reason, the rotary member 16 is moved toward the first position which is the image formation position about the swingable shaft 18 from the second position (FIG. 16) in which the swinging thereof is regulated FIG. 17.

The cover member 100 is dismounted from the removed drum cartridge D. As has been described with respect to FIG. 5, the user grips the rear side of the drum cartridge D, and inserts it into the main assembly 1A through the opening 1D with the leading end at the front side (drum (2) side). The left and right portions to be guided of the drum cartridge D are engaged with the left and right guiding members 40 of the main assembly (1A), respectively. And, the drum cartridge D is sufficiently pushed into the mounting portion 1B along the guiding member 40 until it is caught by the positioning portion. Then, the cover 1*a* is closed (FIG. 1). By the interrelating mechanism in interrelation with this closing movement of the front cover 1*a*, the drum cartridge D is positioned by the positioning fixing means of the main assembly (1A). In addition, the driving output portion of the main assembly (1A) is connected with the driving input portion of the drum cartridge D. In addition, the output power contact of the main assembly (1A) electrically connects to the inputting contact of the drum cartridge D. In this manner, the set-up of the drum cartridge D is completed. When the voltage source of the image forming apparatus 1 of this state is actuated, the initial operation is carried out, so that the image forming operation is enabled.

The cover member 100 of the present embodiment is provided with the rotary member pressing portions 100*b*, 100*c* which are the spacer members for regulating the swinging of the rotary member 16, similarly to the cover member 100 of Embodiment 1. By this, also in taking out the drum cartridge D to the outside of the main assembly 1A, for example, the drum 2 is protected until the cover member 100 is removed. In addition, since the rotary member pressing portions 100*b*, 100*c* can simultaneously be dismounted by the operation of removing the cover member 100, the user's set-up operation can be reduced.

Also in this embodiment, the left and right disc-like side plates 16L, 16R of the rotary member 16 are pressed by the left and right rotary member pressing portions 100*b*, 100*c* of the cover member 100. However, the rotary member pressing portions 100*b*, 100*c* will be satisfactory if the rotary member 16 can be moved to the second position for regulating the swinging in the main assembly 1A. Therefore, only one of the rotary member pressing portions 100*b*, 100*c* may be employed.

Embodiment 3

Figure 20:
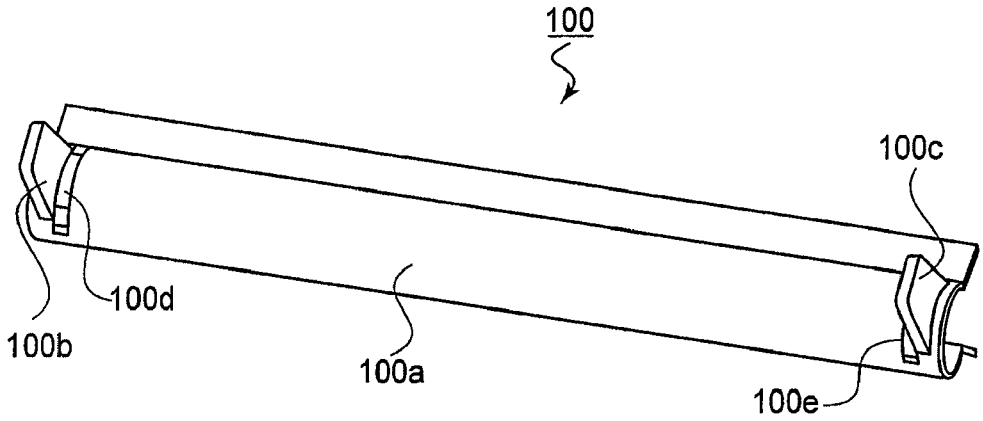
FIG. 20 is a schematic perspective view of the drum cartridge and the cover member according to embodiment 2.

FIG. 20 is a schematic perspective view of the cover member 100 for the drum cartridge D by another embodiment.

The cover member 100 in the present embodiment is provided with the protecting portion 100*a* for protecting the drum 2 and the left and right rotary member pressing portions (spacer members) 100*b*, 100*c*. In addition, it is provided with an opening 100*d* for separating the drum protecting portion 100*a*, and the left side rotary member pressing portion 100*b* from each other, and an opening 100*e* for separating the protecting portion 100*a*, and the right side rotary member pressing portion 100*c* from each other. Since the protecting portion 100*a*, and the rotary member pressing portions 100*b*, 100*c* are separated by the openings 100*d*, 100*e*, the latitude in configurations of the rotary member pressing portions 100*b*, 100*c* increases.

Embodiment 4

Figure 21:
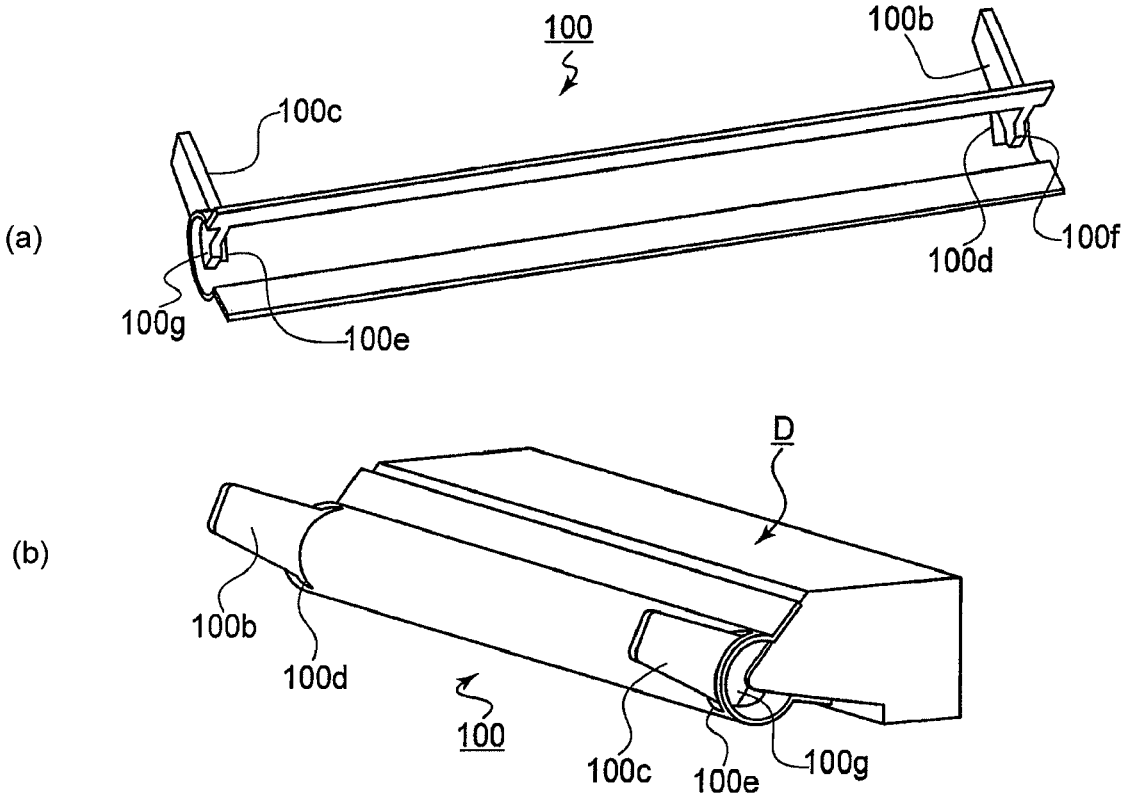
FIG. 21 is a schematic perspective view (b) of a schematic perspective view (a) of the drum cartridge, and the cover member, and a drum cartridge in the state that the cover member is mounted according to embodiment 2.

FIG. 21 shows another example of the cover member 100 for the drum cartridge D, (a) is a schematic perspective view of the cover member 100 according to the present embodiment, and (b) is a schematic perspective view of the drum cartridge D in the state of mounting the cover member 100.

The cover member 100 in the present embodiment is provided with contact portions 100*f*, 100*g* which extend from the rotary member pressing portion (spacer member) 100*b*, 100*c* and which are contacted to a part of drum cartridge D or a non-image region of the drum 2. By this, the reaction force at the time of pushing in the rotary member 16 can be received by the drum cartridge D or the drum 2.

In embodiments 3 and 4, the cover member 100 includes the openings 100*d*, 100*e*, and the protecting portion 100*a* of the cover member 100 and the rotary member pressing portions 100*b*, 100*c* are separated from each other. However, what is necessary is separating the protecting portion 100*a* and the rotary member pressing portions 100*d*, 100*e* from each other, and a groove, a slit and the like can also suitably be used in place of the openings 100*d*, 100*e*.

The electrophotographic image forming apparatus of the present invention has the structure suitable for being transported in the state that the drum cartridge is mounted to the main assembly. In other words, the electrophotographic image forming apparatus which has the structure in which the spacing and the anchoring of the rotatable supporting member for the transportation are easily released by the user can be provided.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 223401/2008 filed Sep. 1, 2008 which is hereby incorporated by reference.

What is claimed is:

1. A drum cartridge detachably mountable to an electrophotographic image forming apparatus, which apparatus includes a main assembly, and a supporting member, swingably mounted to the main assembly of the apparatus, for supporting a plurality of developing devices and for bringing the developing devices sequentially to a developing position by rotation thereof, said drum cartridge comprising:

an electrophotographic photosensitive member drum; and a detachable spacer member for moving the supporting member away from said electrophotographic photosensitive member drum by contacting to the supporting member when said drum cartridge is mounted to the main assembly of the apparatus.

2. A drum cartridge according to claim 1, wherein said spacer member is provided on a covering member covering and protecting said electrophotographic photosensitive member drum.

3. A drum cartridge according to claim 1, wherein a mounting position where said drum cartridge is mounted to the main assembly of the apparatus is upstream, with respect to a mounting direction in which said drum cartridge is mounted to the main assembly of the apparatus, of a mounting position where said drum cartridge is mounted to the main assembly of the apparatus in a state that said spacer member is removed, and is away from an intermediary transfer member, provided in the main assembly of the apparatus, for transferring an image from said electrophotographic photosensitive member drum.

4. An electrophotographic image forming apparatus for forming an image on a recording material, said electrophotographic image forming apparatus comprising:

(i) a supporting member, swingably mounted to a main assembly of said apparatus, for supporting a plurality of developing devices and for bringing the developing devices sequentially to a developing position by rotation thereof;

(ii) mounting means;

(iii) a drum cartridge mounted to said mounting means and including an electrophotographic photosensitive member drum, and a detachable spacer member for moving said supporting member away from said electrophotographic photosensitive member drum by contacting to said supporting member when said drum cartridge is mounted to said main assembly of said apparatus; and (iv) feeding means feeding the recording material.

5. An apparatus according to claim 4, wherein said spacer member is provided to a covering member for covering and protecting said electrophotographic photosensitive member drum.

6. An apparatus according to claim 4, further comprising an intermediary transfer member for transferring an image from said electrophotographic photosensitive member drum, wherein a mounting position where said drum cartridge is mounted to said main assembly of said apparatus is upstream, with respect to a mounting direction in which said drum cartridge is mounted to said main assembly of said apparatus, of a mounting position where said drum cartridge is mounted to said main assembly of said apparatus in a state that said spacer member is removed, and is away from said intermediary transfer member.

* * * * *